US006580021B2

(12) United States Patent
Barney

(10) Patent No.: US 6,580,021 B2
(45) **Date of Patent: *Jun. 17, 2003**

(54) VIBRATORY STRING FOR MUSICAL INSTRUMENT

(76) Inventor: Jonathan A. Barney, 312 Signal Rd., Newport Beach, CA (US) 92663

( * ) Notice: Subject to any disclaimer, the term of this patent is extended or adjusted under 35 U.S.C. 154(b) by 10 days.

This patent is subject to a terminal disclaimer.

(21) Appl. No.: 09/917,552

(22) Filed: Jul. 27, 2001

(65) Prior Publication Data

US 2002/0035912 A1 Mar. 28, 2002

Related U.S. Application Data

(63) Continuation of application No. 09/239,234, filed on Jan. 28, 1999, which is a continuation-in-part of application No. PCT/US00/02320, filed on Jan. 28, 2000.

(51) Int. Cl.[7] ..... G10D 3/00
(52) U.S. Cl. ..... 84/29.75; 84/199
(58) Field of Search ..... 84/199, 29.75

(56) References Cited

U.S. PATENT DOCUMENTS

| | | | | |
|---|---|---|---|---|
| 3,753,797 | A | | 8/1973 | Fukuda |
| 4,161,129 | A | | 7/1979 | Carbone |
| 4,184,405 | A | | 1/1980 | How |
| 4,244,268 | A | | 1/1981 | Barham et al. |
| 4,281,576 | A | | 8/1981 | Fender |
| 4,453,443 | A | | 6/1984 | Smith |
| 4,509,399 | A | | 4/1985 | McKibben |
| 4,833,027 | A | | 5/1989 | Ueba et al. |
| 4,909,510 | A | | 3/1990 | Sahatjian |
| 5,341,818 | A | | 8/1994 | Abrams et al. |
| 5,361,667 | A | | 11/1994 | Pritchard |
| 5,423,241 | A | | 6/1995 | Scarton et al. |
| 5,427,008 | A | | 6/1995 | Ueba et al. |
| 5,578,775 | A | | 11/1996 | Ito |
| 5,587,541 | A | | 12/1996 | McInthosh et al. |
| 5,617,377 | A | | 4/1997 | Perret, Jr. |
| 5,620,320 | A | | 4/1997 | Luse et al. |
| 5,637,818 | A | | 6/1997 | Fishman et al. |
| 5,773,737 | A | | 6/1998 | Reyburn |
| 5,811,909 | A | | 9/1998 | Wuchinich |
| 5,842,312 | A | | 12/1998 | Krumme et al. |
| 5,843,244 | A | | 12/1998 | Pelton et al. |
| 5,859,379 | A | | 1/1999 | Ichikawa |
| 5,913,257 | A | | 6/1999 | Schaller et al. |
| 5,958,159 | A | * | 9/1999 | Prandi ..... 148/402 |
| 6,057,498 | A | | 5/2000 | Barney |
| 6,215,073 | B1 | * | 4/2001 | Avellanet et al. ..... 174/128.1 |

OTHER PUBLICATIONS

How Guitars Work How Stuff Works.
The Expert In Nitinol Nitino Devices and Components.
Nitinol Materials and Components for the Medical Device Industry.

* cited by examiner

*Primary Examiner*—Shih-Yung Hsieh

(57) ABSTRACT

An improved vibratory string is provided for use in musical instruments such as pianos, guitars, violins and the like. The string is formed from one or more wires of a selected alloy material, such as Ni—Ti alloy, having desired superelastic properties at ambient room temperature. Such a vibratory string tensioned or strained to its superelastic state has improved harmonic and tonal stability characteristics.

43 Claims, 22 Drawing Sheets

VIBRATORY STRING FOR MUSICAL INSTRUMENT

RELATED APPLICATIONS

This Application claims priority under 35 USC § 119 to PCT application Ser. No. US00/02320, filed Jan. 28, 2000, which claims priority to U.S. application Ser. No. 09/239,234 filed Jan. 28, 1999.

BACKGROUND OF THE INVENTION

1. Field of the Invention

The present invention relates to vibratory strings or music wire for musical instruments such as pianos, guitars, violins, violas and the like, and, in particular, to improved string materials for producing vibratory strings having improved harmonic, tonal and stability characteristics.

2. Description of the Related Art

Few musical experiences are more beautiful and fulfilling than listening to live music performed on an acoustic instrument such as a grand piano, guitar or violin. The tonal quality, tenor and intricate harmonics of traditional acoustic instruments have been unsurpassed even by the recent advent of modem digital/electronic sampling and reproduction techniques. However, as improvements and advancements in digital-electronic sound reproduction continue, more and more musicians and music hobbyists/enthusiasts are choosing to purchase and play digital electronic keyboard instruments and the like, rather than their acoustical (i.e., stringed) counterparts.

This shift in consumer preferences can be attributed largely to the relative low cost of such electronic instruments, the diversity of sound reproduction and amplification achieved and the ready portability of such instruments. However, another important consideration is that digital-electronic instruments, unlike their acoustic counterparts, generally do not require periodic tuning and maintenance.

Anyone who has owned or played an acoustic piano knows that it must be periodically tuned by a skilled technician in order to keep it in optimal playing condition. Acoustic pianos used for concert tour performances must be constantly tuned and retuned in order to keep the instruments in proper pitch and tune under a variety of ambient conditions. Even then, the pitch of the instrument is sometimes liable to drift if ambient conditions should change abruptly or if the instrument is not allowed adequate time to become acclimated to a new ambient environment. As a result of these inherent sensitivities to changing ambient conditions, and because of the large number of strings and other mechanisms involved, maintaining a concert grand piano in optimal pitch prior to and during a concert performance can be a vexing and time-consuming task.

A typical concert grand piano includes a plurality of longitudinally arranged vibratory strings or wires of varying length overlying a plurality of hammers. The number of strings per note will vary, depending upon the desired pitch of the note, i.e., typically one string per note in the lower octaves and two or three strings per note in the mid and upper octaves. Each string is vibrationally fixed or grounded at one end by a hitch pin located on the bowed portion of the piano harp and, at the other end, by an adjustable tuning pin frictionally and rotatably retained in a tuning ("pin") block. The strings are placed under tension by turning or adjusting the tuning pin. The tensioned strings are thus capable of sustained vibration.

A sound board, typically formed from laminated or glued strips of a light hardwood such as spruce, is disposed underneath the tensioned strings for the purpose of acoustically amplifying the vibrations of the activated string or strings into audible sound. The sound board includes one or more bridges, typically of hard rock maple, on which each string bears down. The distance between the bridge and the tuning pin defines the active length of the string. The sound board is typically crowned such that it bows upward pressing the bridge (or bridges) into the taught strings. This improves the acoustic qualities of the piano and helps the sound board support the immense downward pressure brought to bear against it by the tensioned strings.

In operation, when a string (or strings) is struck by an associated hammer the string is set into mechanical vibration whereby a sound having a particular desired pitch is produced. The pitch depends largely upon the active length of the string, its weight or mass and the amount of tension applied. Thus, the shorter, smaller diameter strings located at the treble end of a piano typically produce a relatively high pitched sound whereas the longer, larger diameter strings disposed at the bass end of the piano produce a lower pitched sound. The tonal quality of the sound produced depends on a number of additional factors, such as the particular mechanical properties of the material or materials comprising the string, its ductility, tensile strength, modulus of elasticity, resistance to bending and density per unit length. Each of these properties can effect the tonal quality, tenor and dwell of a particular note, as well as the occurrence or selected amplification or attenuation of various harmonic partials.

For purposes of the present disclosure, a "partial" is defined as a component of a sound sensation which may be distinguished as a simple sound that cannot be further analyzed by the ear and which contributes to the overall character of the complex tone or complex sound comprising the note. The fundamental frequency of the string is the frequency of the first partial, or that frequency caused by the piano string vibrating in the first mode, or the lowest natural frequency of free vibration of the string. A harmonic is a partial whose frequency is usually an integer multiple (e.g., n=1, 2, 3 . . . ) of the frequency of the first partial or fundamental frequency of the string.

Due to the nature of strings being strung and then tuned., strings for musical instruments are required to keep strong tension and a high degree of stability for a long period of time. Strings which plastically deform or stretch by bowing, plucking or striking are typically not used on musical instruments because they typically lack sufficient elastic compliance to sustain vibratory motion for any useful period of time and can also deform or permanently stretch if struck or plucked to hard.

Conventional vibratory strings used for pianos, electric guitars and similar musical instruments are typically made of materials having relatively high elastic modulus (greater than about 180 GPa), such as carbon steel wire, stainless steel wire, phosphor bronze wire and the like. Often a carbon steel wire core having a diameter of about 0.090 inches will be wound with annealed copper wire or other precious or semi-precious metals in order to change the density per unit length of the string and to enable optimal adjustment of sound quality, attenuation rate and selection of the basic vibration frequency. Thus, U.S. Pat. No. 5,578,775 to Ito describes a vibratory string for use on musical instruments comprising a core wire composed of long filaments of steel wire, sheathed with a thick mantle of a precious metal such as gold, silver, platinum, palladium, copper, or the like. U.S.

Pat. No. 3,753,797 to Fukuda describes an improved string for a stringed instrument comprising carbon steel wire electrically heat treated under tensile stress to reduce residual stress in the string and thereby minimize tonal variation over long periods of time after the string has been strung in the instrument. For classical acoustic guitars, violins, violas, acoustic bases and similar instruments, a more compliant material may be chosen, such as cat gut, sheep gut or synthetic resins in order to achieve the desired tonal and acoustic qualities.

Notwithstanding the significant improvements made in vibratory string technology over the years, acoustic instruments remain quite sensitive to even small changes in temperature, humidity and other ambient conditions. Even a very small change in the stretch or amount of tension on a conventional vibratory string can result in significant detuning of the string. Such changes may result from, among other things, environmental conditions, such as temperature, humidity and the like, which may cause portions of the sound board, bridge and/or harp to expand or contract and thereby alter the string length/tension. These changes can cause the piano or other string instrument to produce a less than optimum sound, especially if rather large or frequent changes are experienced.

During the initial tuning of a piano or other stringed instrument by factory personnel, the tensioning or de-tensioning of the various strings can cause similar changes in the shape of the sound board, bridge and/or harp, particularly the degree of crowning of the sound board. The latter is directly affected by the total amount of downward pressure exerted on the sound board by the strings under tension. Thus, repeated iterative tunings at the factory over the course of several days or weeks are normally necessary to achieve a desired stable tonal range. The iterative nature of this initial tuning process and the large number of strings involved makes this an expensive and time-consuming process.

After a piano is put into service, periodic adjustment and maintenance by a skilled piano technician is required to keep the strings optimally tuned. As noted above, such tuning is carried out by rotating the various tuning pins, thereby either tightening or loosening each associated string. But, repeated adjustment of the tuning pins over years of use tends to adversely affect the tuning pins and/or the pin block in which they are frictionally retained. As a result, the pin block of an older piano will often become so worn by repeated tunings that the tuning pins no longer have sufficient frictional engagement with the pin block to prevent them from rotating under the stress of the tuned string. In such case the piano will not be able to hold its tune for prolonged periods and must either be tuned much more frequently or the pin block must be repaired or replaced.

But even with the piano properly tuned, it is still subject to certain inharmonicities which can adversely affect the tonal quality of the piano, particularly in the bass range. "Inharmonicity" refers to the observed increase in the pitch of higher harmonic partials of a vibrating non-ideal string. Depending upon the physical and mechanical characteristics of the string material, these harmonic partials can sometimes vibrate at such elevated pitches that they produce disharmony with the fundamental and lower harmonic partials, causing unpleasant overtones. Undesirable overtones are particularly noticeable in the seventh, ninth and higher harmonic partials, especially in the lower range of the bass scale.

Conventionally, piano manufacturers have attempted to compensate for these unpleasant overtones and inharmonics by carefully selecting the strike point of the hammer so that it falls on or near a node of the partial harmonic(s) desired to be attenuated. See, for example, U.S. Pat. No. 4,244,268 to Barham. While such approaches are generally accepted to produce improved tonal quality, they have not been completely successful in removing all of the undesired disharmonic overtones. Rather, they are compromise approaches which attempt to attenuate as much as possible those disharmonic overtones that the human ear finds most unpleasant.

SUMMARY OF THE INVENTION

Accordingly, it is a principle object and advantage of the present invention to over-come some or all of these limitations and to provide a vibratory string for a musical instrument having improved harmonics, tonal stability and reduced inharmonicity.

In accordance with one embodiment of the invention a vibratory string is provided constructed of a nickel/titanium alloy material, also known as "Nitinol" or "NiTi." Such alloys have several peculiar properties that make them particularly advantageous for use in constructing a vibrational string. In particular, the alloys have the unusual ability to reversibly change their crystalline structure from a hard, relatively high-modulus "austentitic" crystalline form to a soft, ductile "martensitic" crystalline form upon application of pressure and/or by cooling. This results in a highly elastic material having a very pronounced pseudo-elastic strain characteristic. This pseudo-elastic elastic strain phenomena is characterized by a flattened portion of the stress-strain curve wherein the induced stress remains essentially constant over a relatively large strain (up to about 6%). This unique property is often described as "superelasticity".

When a musical string is constructed of such a material and stretched to its superelastic state, the tension of the string remains essentially constant regardless of the expansion or contraction of the contacting sound board/bridge against the string and/or the expansion and contraction of the supporting structure. Vibratory strings formed of NiTi alloy wire and properly tensioned also hold a more constant pitch over time than conventional string materials, even when subjected to significant ambient temperature and humidity changes and expansions and contractions of the sound board and supporting structure.

Advantageously, vibrational strings constructed of NiTi wire are less susceptible to "creep" over time. Thus, while conventional steel guitar and piano strings tend to drift down in frequency over time, strings constructed from NiTi wire are found to hold a more constant pitch over long periods of time. Conventional steel wires drift down in frequency over time because of gradual material creep and/or because of plastic strain or stretch in response to temperature and humidity fluctuations. Because of the unique ability of NiTi wire to elastically recover large amounts of strain, vibratory strings constructed of NiTi wire are significantly less susceptible to such effects.

Vibratory strings constructed of NiTi wire are also found to be more robust and less susceptible to corrosion and breakage than strings constructed of conventional materials. Again, because of the ability of NiTi wire to elastically recover large amounts of strain, strings constructed of NiTi wire are found to resist breakage and return to their original shape/pitch even when plucked and strained vigorously and even when exposed to large temperature extremes and corrosive humidity over long periods of time. The large elastic recovery of NiTi wire strings also enables them to vibrate with more energy than strings constructed of conventional materials, such as steel.

While NiTi wires are generally found to be tonally stable over long periods of time, the pitch of a tensioned NiTi wire (depending on the amount of tension applied) can be affected by temperature changes. Surprisingly, however, the temperature response for a NiTi wire is completely reverse to what one normally finds with a vibratory string constructed of conventional materials such as carbon steel. Conventional vibratory strings universally go down in pitch with increasing temperature. Strings constructed of NiTi wire are found to go up in frequency with increasing temperature and vice versa. The exact temperature relationship depends upon the exact alloy material used and the amount of tension applied.

Moreover, by adjusting the tension of a NiTi wire string and/or by combining NiTi alloy(s) and conventional string materials together it is possible to construct a vibratory string having a completely neutral temperature response or an effective thermal expansion coefficient of or about 0.0/° C. Such a string would be most useful in many applications requiring high tonal stability in a variety of ambient conditions.

Other salient features and advantages of a vibratory string constructed and used in accordance with the present invention include:

(1) unique and pleasant sound quality (2) high tonal stability over time (even when "abused")

(3) tonal stability with temperature/humidity changes (4) less string breakage (more stretch and forgiveness)

(5) impervious to sweat & humidity (6) louder sound (more stretch/energy storage)

(7) reduced inharmonicity

In accordance with one embodiment the present invention provides a vibratory string for musical instruments comprising a core formed of one or more filaments or wires of an alloy material selected to have superelastic properties at or about room temperature. The core is impregnated, coated or wound with a second material comprising a precious or semiprecious metal, such as copper, gold, or silver or an alloy thereof.

In accordance with another embodiment the present invention provides a musically tuned vibratory string comprising one or more filaments or wires of an alloy material selected to have superelastic properties at or about room temperature. The vibratory string is secured and supported so as to have an active length thereof capable of sustained vibration. The vibratory string is tensioned or strained to its superelastic state whereby a musical tone may be generated. In a further preferred embodiment the musically tuned vibratory string comprises a Ni—Ti alloy wire having a characteristic thermoelastic martensitic phase transformation at a transformation temperature (TT). The string is tensioned or strained to the point of causing at least some stress-induced crystalline transformation from an austenitic crystalline structure to a martensitic crystalline structure.

In accordance with another embodiment the present invention provides a musical instrument strung with one or more vibratory strings comprising a wire formed of an alloy material selected to have superelastic properties at or about room temperature. Optionally, the vibratory strings may be tensioned or strained to their superelastic condition. In a further preferred embodiment, at least one of the vibratory strings comprises a Ni—Ti alloy comprising, for example, between about 49.0 to 49.4% Ti and having a characteristic thermoelastic martensitic phase transformation at a transformation temperature (TT) and the string is tensioned or strained to the point of causing stress-induced crystalline transformation from an austenitic crystalline structure to a martensitic crystalline structure.

In accordance with another embodiment the present invention provides a method for stringing a stringed musical instrument. A vibratory string is selected comprising one or more wires formed of an alloy material having superelastic properties at or about room temperature. A first end of the string is then secured to the instrument. A second end of the string is then also secured to the instrument and the string is supported on the instrument so as to provide an active length thereof capable of sustained vibration. Finally, the string is tensioned or strained to its superelastic state. In a further preferred method, the vibratory string is selected to comprise a Ni—Ti alloy having a characteristic thermoelastic martensitic phase transformation at a transformation temperature (TT) at or below room temperature and the string is tensioned or strained to the point of causing stress-induced crystalline transformation from an austenitic crystalline structure to a martensitic crystalline structure. In yet a further preferred method, the vibratory string is selected to comprise a Ni—Ti alloy having a transformation temperature (TT) between about 15° C. and −100° C.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
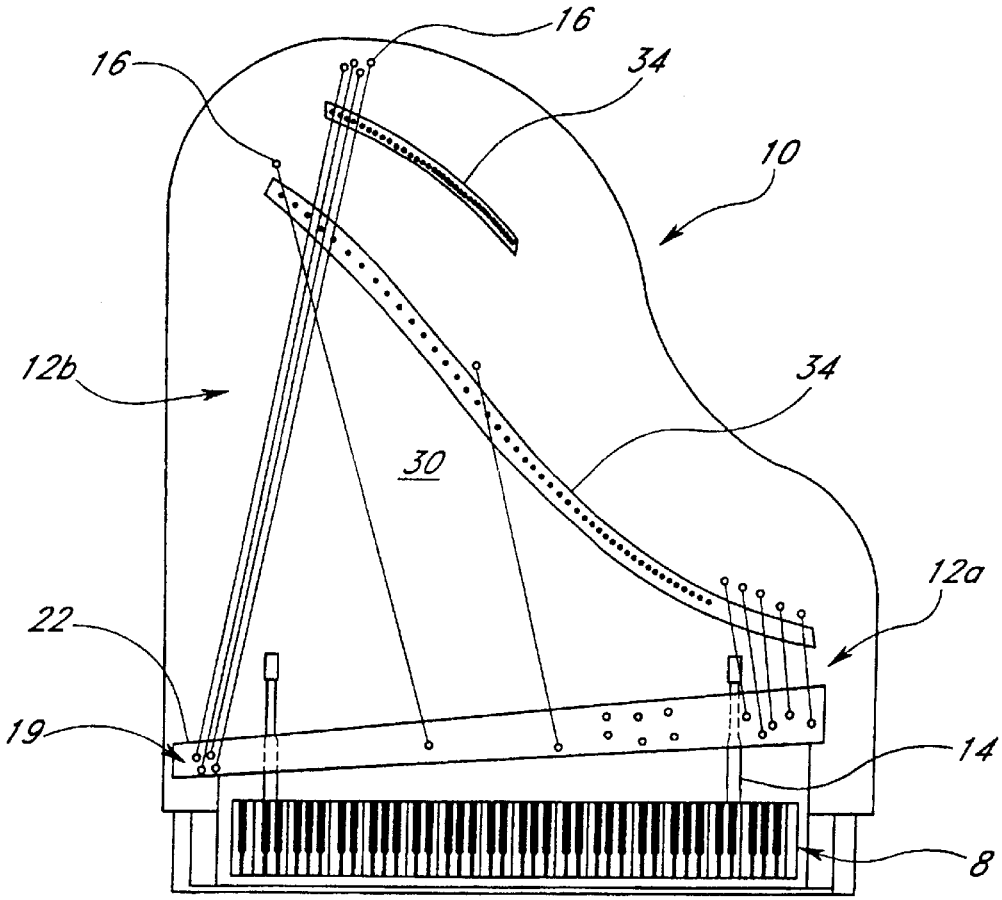
FIG. 1 is a top plan view illustrating the inner workings of an acoustic grand piano.
Figure 2:
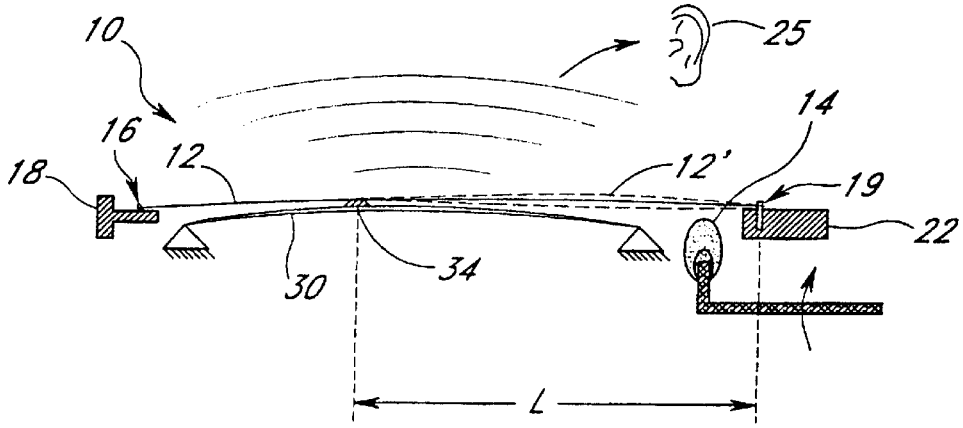
FIG. 2 is a schematic diagram illustrating the basic principles of sound generation within an acoustic piano.

FIG. 1 is a top plan view of the inner workings 10 of an acoustic grand piano 1 illustrating its basic construction and operation. FIG. 2 is a schematic cross-sectional view illustrating in more detail the inner workings 10 of an acoustic piano and the basic principles of sound generation. For convenience and ease of description only one note-producing element is shown and described. However, those skilled in the art will readily appreciate that a plurality of such note producing elements (usually 88) are provided in a typical piano and all are constructed and operate in a similar manner.

Referring to FIG. 1, it will be understood that a plurality of longitudinally arranged vibratory strings or wires 12 of varying length are provided overlying a plurality of hammers 14. The number of strings per note will vary, depending upon the desired pitch of the note, i.e., typically one string per note in the lower octaves and two or three strings per note in the mid and upper octaves. Each string is vibrationally fixed or grounded at one end by a hitch pin 16 located on a portion of the piano harp 18 (FIG. 2) and, at the other end, by an adjustable tuning pin 19 frictionally and rotatably retained in a tuning block or "pin block" 22. The string 12 is placed under tension by rotating or adjusting the tuning pin 19, thereby winding the string 12 onto the pin 19.

A sound board 30, typically formed from laminated or glued strips of a light hardwood such as spruce, is disposed underneath the vibratory strings 12 in order to acoustically amplify the vibrations of the activated string or strings 12 into audible sound. The sound board includes one or more bridges 34, typically of hard rock maple, on which each string 12 under tension bears down. The distance between the bridge and the tuning pin defines the active length "L" of the string. The sound board 30 is typically crowned, as shown, such that it bows slightly upward pressing the bridge (or bridges) 34 into the taught strings 12. This configuration has been demonstrated to improve the acoustic qualities of the piano and also helps the sounding board 30 support the immense downward pressure brought to bear against it by the tensioned strings 12.

When the tensioned string (or strings) 12 is struck by the associated hammer 14 the string 12 is set into mechanical vibration (indicated by dashed lines 12'). This vibrational energy is transmitted through the bridge 34 to the sound board 30 whereby a sound having a particular desired pitch is produced that can be audibly detected by the human ear 25. The pitch of the sound produced depends largely upon the active length "L" of the string 12, its weight or mass and the amount of tension applied. Thus, the shorter, smaller diameter strings 12*a* located at the treble end of a piano typically produce a relatively high pitched sound whereas the longer, larger diameter strings 12*b* disposed at the bass end of the keyboard produce a much lower pitched sound.

Figure 3A:
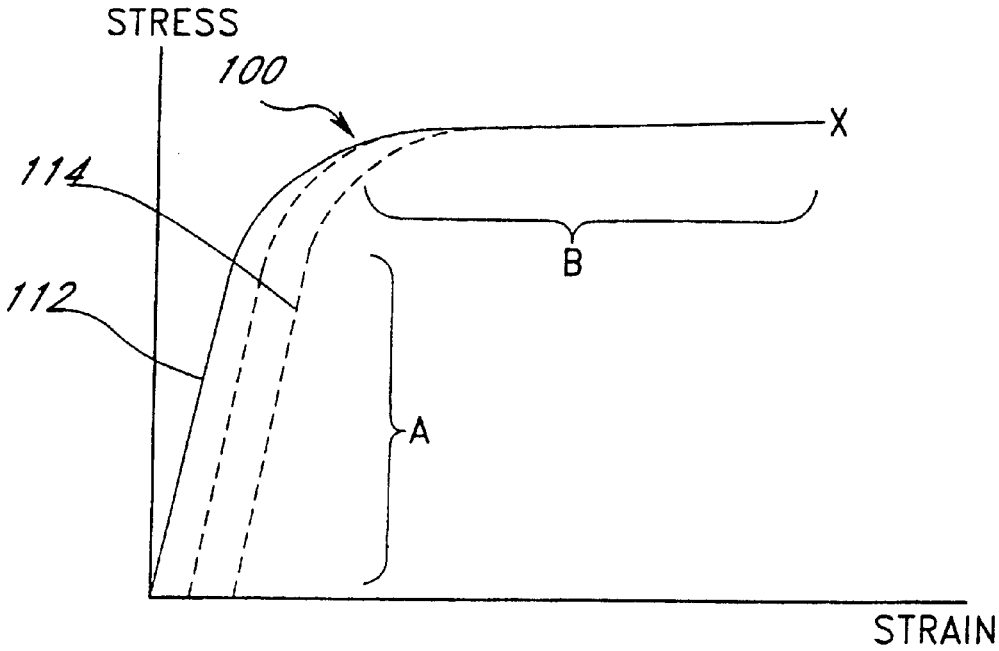
FIG. 3A is a typical stress-strain curve for a vibratory string comprising a conventional carbon steel piano wire.

Conventional vibratory strings for pianos and similar stringed instruments are made of carbon steel wire, stainless steel wire, phosphor bronze wire or other similar wire material having high ultimate tensile strength and high modulus of elasticity. FIG. 3A is a stress-strain diagram illustrating the tensile response characteristic of a typical steel piano wire. The stress-strain curve 100 may aptly be characterized as having two distinct regions "A" and "B", as indicted. The region "A" is characterized by elastic strain whereby the steel wire experiences stress-induced elongation that does not permanently deform the steel wire and, therefore, is fully reversible or recoverable once the stress is relieved. The stress-strain curve is generally linear in this region such that stress (and, therefore, wire tension) is roughly proportional to the amount of strain. The slope of the curve in the elastic region "A" is equal to Young's modulus, or the modulus of elasticity for the material. This is the desired range for tensioning a conventional steel piano wire.

The region "B" is characterized by plastic strain whereby the steel wire experiences stress-induced elongation and permanent deformation that is not fully recoverable. The dashed lines 112, 114 indicate typical elongation recovery curves following varying degrees of plastic strain. Curves 112 and 114 are shifted to the right indicating permanent elongation and deformation of the wire.

FIG. 3A illustrates an inherent characteristic of conventional steel piano wire which limits its tonal stability under changing ambient conditions. In particular, the relatively high modulus of elasticity of steel wire (205 GPa) produces a steep yield curve in the elastic Region "A". Persons skilled in the art will readily appreciate that within the elastic range "A" even a relatively small change in the amount of strain, such as may be caused by environmentally-induced changes or expansion or contraction of the sound board or surrounding support structure (see FIG. 2), can cause a relatively large change in the amount of stress (tension) retained by the wire and, thus, a relatively large change in the fundamental pitch of the vibratory string or wire. The degree and frequency that such environmental changes are experienced will dictate how often the string tension must be readjusted by a skilled technician to maintain the instrument in optimal pitch.

Of course, other environmental factors can also have a similar detuning effect on a tensioned string. Such factors may include, for example, temperature-induced expansion or contraction of the wire itself, plastic creep caused by prolonged stress, and even changes in the mass and/or density of the wire due to corrosion or accumulation of dirt, oil or other deleterious contaminants. However, changes in the surrounding support structure, and particularly changes in the shape of the sound board and bridge, are believed to be a large, if not the dominant, factor accounting for detuning of a conventionally strung piano.

Superelastic Alloy Wire

In accordance with one embodiment of the present invention an improved vibratory string 12 for musical instruments is provided comprising one or more wires formed from an alloy of titanium and nickel (Ni—Ti) —commonly known as Nitinol or "NiTi"—having superelastic properties. Such materials may be obtained from any one of a number of supplier/fabricators well known in the specialty metals supply industry. In the preferred embodiment a NiTi superelastic alloy comprising approximately equal parts nickel and titanium was selected. Wire formed from such alloy in various diameters may be obtained, for example, from Memry Corporation under the specified alloy name "Nitinol BA".

In general, such alloy compositions of nickel (Ni) and titanium (Ti), produce stable and useful alloys having a relatively low modulus of elasticity (83 GPa) over a wide range, a relatively high yield strength (195–690 MPa), and the unique and unusual property of being "superelastic" over a limited temperature range. Superelasticity refers to the highly exaggerated elasticity, or spring-back, observed in many Ni—Ti and other superelastic alloys over a limited temperature range. Such alloys can deliver over 15 times the elastic motion of a spring steel, i.e., withstand a force up to 15 times greater without permanent deformation. The particular physical and other properties of Nitinol alloys may be varied over a wide range by adjusting the precise Ni/Ti ratio used. Generally, useful alloys with 49.0 to 50.7 atomic % of Ti are commercially available, but alloys in the range of 49.0 to 49.4% Ti are most preferred for purposes of practicing the present invention. Special annealing processes, heat treatments and/or the addition of trace elements, such as oxygen (O), nitrogen (N), iron (Fe), aluminum (Al), chromium (Cr), cobalt (Co) vanadium (V), zirconium (Zr) and copper (Cu), can also have very significant effects on desired superelastic properties and performance of the materials. See, for example, U.S. Pat. No. 5,843,244 to Pelton. Of course, the invention disclosed herein is not limited specifically to Ni—Ti alloys, but may be practiced using any one of a number of other suitable alloy materials having the desired superelastic properties, such as Silver-Cadmium (Ag—Cd), Gold-Cadmium (Au—Cd) and Iron-Platinum (Fe3Pt), to name but a few. The actual mechanics of superelasticity on a micro-crystalline level have been studied and reported extensively in the literature, particularly binary alloys of nickel and titanium. See, for example, *Structure and Properties of Ti—NI Alloys: Nitinol Devices & Components*, Duerig et al., Titanium Handbook, ASM (1994). For purposes of this disclosure and for understanding and practicing the invention, however, it is not particularly important that these aspects be explained or understood. A very brief explanation of the crystalline structure and operation of a typical superelastic alloy material is provided below for purposes of general background understanding and assisting those skilled in the art in selecting and modifying suitable materials for carrying out the invention.

Most superelastic alloys, such as Ni—Ti, display a characteristic thermoelastic martensitic phase transformation and a Transformation Temperature (TT), which is specific to each alloy and each alloy possesses unique mechanical and transformation properties. As these alloys are cooled through their TT, they transform from the higher temperature austenite phase to the lower temperature martensite phase. The physical properties of these materials also change significantly as their respective TTs are approached. In general, at lower temperatures, these alloys will exist in a martensite state characterized as weak and easily deformable. However, in the austenite state, the high temperature phase, the alloys become strong and resilient with a much higher yield strength and modulus of elasticity.

Superelasticity in Ni—Ti alloys derives from the fact that the alloy, if deformed at a temperature above its transformation temperature, is able to undergo a stress-induced shift from its strong austenite crystalline structure to the relatively weak and compliant martensite crystalline structure. However, because such stress-induced formation of martensite occurs above the alloy's normal transformation temperature, it immediately and completely reverts to its undeformed austenite state as soon as the stress is removed. As a result of this fully reversible stress-induced crystalline transformation process a very springy or rubber-like elasticity ("superelasticity") is provided in such alloys. However, the desired superelastic property is usually only obtainable when the alloy is maintained at or above its transformation temperature. For that reason, and for purposes of practicing the invention it is generally desirable to select a superelastic alloy having a relatively low transformation temperature. Preferably the transformation temperature is selected to be at least below normal room temperature of about 25° C. and is most preferably selected to be between about 15° C. and −200° C.

TABLES 1–4 below list certain selected properties of NiTi alloys having preferred application to the present invention:

TABLE 1

| MECHANICAL PROPERTIES | |
|---|---|
| Young's Modulus | |
| austenite | ~83 GPa ($12 \times 10^6$ psi) |
| martensite | ~28 to 41 GPa (~$4 \times 10^6$ to $6 \times 10^6$ psi) |
| Yield Strength | |
| austenite | 196 to 690 MPa (28 to 100 ksi) |
| martensite | 70 to 140 MPa (10 to 20 ksi) |
| Ultimate Tensile Strength | |
| fully annealed | 895 MPa (130 ksi) |
| work hardened | 1900 MPa (275 ksi) |
| Poisson's Ratio | 0.33 |
| Elongation at Failure | |
| fully annealed | 25 to 50% |
| work hardened | 5 to 10% |

TABLE 2

| Physical Properties | |
|---|---|
| Melting Point | 1300° C. (2370° F.) |
| Density | 6.45 g/cm$^3$ (0.233 lb/in$^3$) |
| Thermal Conductivity | |
| austenite | 0.18 W/cm · ° C. (10.4 BTU/ft · hr · ° F.) |
| martensite | 0.086 W/cm · ° C. (5.0 BTU/ft · hr · ° F.) |
| Coeff. of Therm. Expansion | |
| austenite | $11.0 \times 10^{-6}$/° C. ($6.11 \times 10^{-6}$/° F.) |
| martensite | $6.6 \times 10^{-6}$/° C. ($3.67 \times 10^{-6}$/° F.) |
| Specific Heat | 0.20 cal/g · ° C. (0.20 BTU/lb · ° F.) |
| Corrosion Performance | excellent |

TABLE 3

| Transformation Properties | |
|---|---|
| Transformation Temperature | −200 to +110° C. |
| Latent Heat of Transformation | 5.78 cal/g |
| Transformation Strain (for | |

TABLE 3-continued

| Transformation Properties | |
|---|---|
| polycrystalline material) | |
| for 1 cycle | max 8% |
| for 100 cycles | 6% |
| for 100,000 cycles | 4% |
| Hysteresis | 30 to 50° C. |

TABLE 4

| Electrical and Magnetic Properties | |
|---|---|
| Resistivity (ρ) | |
| austenite | ~100 $\mu\Omega \cdot$ cm (~39 $\mu\Omega \cdot$ in) |
| martensite | ~80 $\mu\Omega \cdot$ cm (~32 $\mu\Omega \cdot$ in) |
| Magnetic Permeability | <1.002 |
| Magnetic Susceptibility | $3.0 \times 10^6$ emu/g |

For purposes of conducting initial experimentation a wire diameter of 0.38 mm was selected. However, it will be readily apparent to those skilled in the art that the particular wire diameter may vary over a wide range, depending upon the nature of the instrument to be strung, the desired pitch and the active length of the wire. Also, it will be readily apparent to those skilled in the art that multiple filaments of such wire may be bundled, swaged, rolled, braided or otherwise joined together and used as a single vibratory string, if desired.

Figure 4:
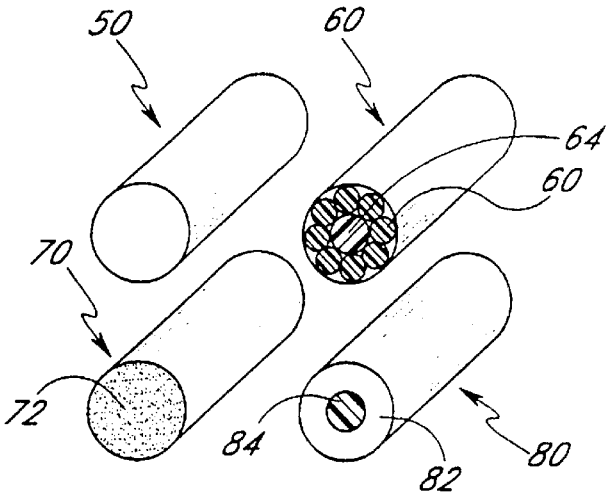
FIG. 4 is a transverse cross-sectional view of four alternative embodiments of a vibrational string having features and advantages in accordance with the present invention.

FIG. 4 illustrates several possible alternative embodiments of a vibratory string constructed of a NiTi alloy material. Thus, string 50 comprises a single solid NiTi alloy wire having a desired diameter and cut to any desired length for use as a vibratory string within a stringed instrument. String 60 comprises a bundle of smaller diameter wires 62 comprising one or more wires of NiTi alloy material wrapped around a core 64 comprising a NiTi alloy wire and/or steel wire or other materials, the string having a desired overall diameter and cut to any desired length for use as a vibratory string within a stringed instrument. String 70 comprises a bundle of even smaller diameter wires or filaments 72 comprising one or more NiTi alloy materials and/or other materials, the string having a desired diameter and cut to any desired length for use as a vibratory string within a stringed instrument. String 80 comprises a core 84 of steel wire surrounded by a coating or covering 82 comprising a selected NiTi alloy material having a desired diameter and cut to any desired length for use as a vibratory string within a stringed instrument. Alternatively, string 80 may comprise a core 84 of NiTi alloy wire surrounded by a coating or covering of steel or other material. In any of the above examples or modifications thereof, the resulting wire or wire bundle may also be coated or impregnated with a suitable binder or protective covering, as desired, and/or may be wound with copper or other suitable materials as is know in the art to achieve a desired density per unit length of the active string length. This allows for optimal adjustment of sound quality, attenuation rate and selection of the basic vibratory frequency of the vibratory string.

Figure 5A:
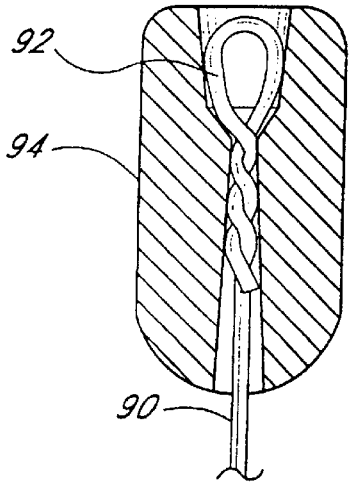
FIG. 5A is a longitudinal cross-sectional view of a guitar string having features and advantages in accordance with the present invention.
Figure 5B:
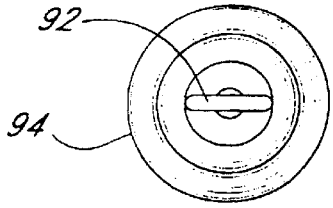
FIG. 5B is a top plan view of the guitar string of FIG. 5A.

FIGS. 5A and 5B illustrate another possible embodiment of a vibratory string constructed of a NiTi alloy material and particularly adapted for use in guitar. Thus, string 90 comprises a NiTi alloy wire or hybrid NiTi string having a desired diameter and cut to any desired length. The wire 90 is looped or shaped at the end 92 by twisting 5–10 turns and then applying heat (e.g. using a flame, or electric current) immediately adjacent the portion of wire to be looped while preferably avoiding heating the musically active portion of the wire 90. The heated portion of the wire 90 will become temporarily very soft and ductile and will wrap tightly around itself as illustrated, thereby providing a secure end for fastening to the string-securement portion or tailpiece of the guitar. If desired, the looped end 92 may be fitted to an eyelet, grommet, or other suitable retaining structure for retaining the string 90 and securing it to a guitar. Most preferably, the end 92 of the string 90 is forcibly embedded in a bullet-like securement lug 95 in a manner illustrated and described in U.S. Pat. No. 5,913,257, incorporated herein by reference.

Figure 3B:
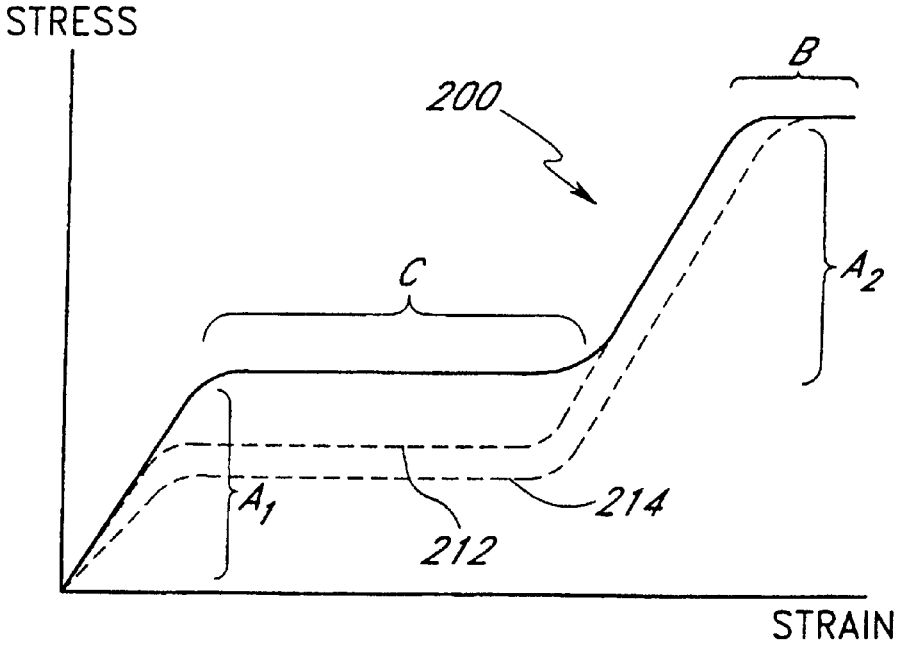
FIG. 3B is a stress-strain curve for a vibratory string comprising wire formed of a superelastic alloy in accordance with one embodiment of the present invention.

FIG. 3B is a stress-strain diagram illustrating the tensile response characteristic of a wire formed from a superelastic alloy such as NitinolΘ. In this case, the stress-strain curve 200 has two elastic regions generally denoted "$A_1$" and "$A_2$" wherein the wire experiences reversible stress-induced elongation and wherein the amount of strain is generally proportional to the amount of stress (tension) applied in accordance with the modulus of elasticity of the material in those regions. The stress-strain curve 200 also illustrates that the wire undergoes plastic or permanent deformation in the region "B" wherein the wire experiences stress-induced elongation and permanent deformation that is not fully recoverable, as illustrated by the elongation recovery line 214. The curve also illustrates the unique superelastic region "C" wherein the wire experiences reversible elongation over a range of constant or substantially constant stress (tension). Elongation recovery line 212 illustrates that the stress-induced elongation is fully recoverable so that no appreciable permanent deformation or elongation of the wire is experienced over the region "C". The elongation recovery in the superelastic region "C" does exhibit some Hysteresis effect, as illustrated in FIG. 3B, and thus some energy loss. However, it has been determined experimentally that such Hysteresis does not significantly dampen or inhibit the free harmonic response of a wire that is strained or tensioned to its superelastic state, generally defined by the superelastic region "C". Such hysteresis effects are further minimized and/or eliminated as the wire is strained into the elastic region "$A_2$."

Increased Energy Capacity

Figure 3C:
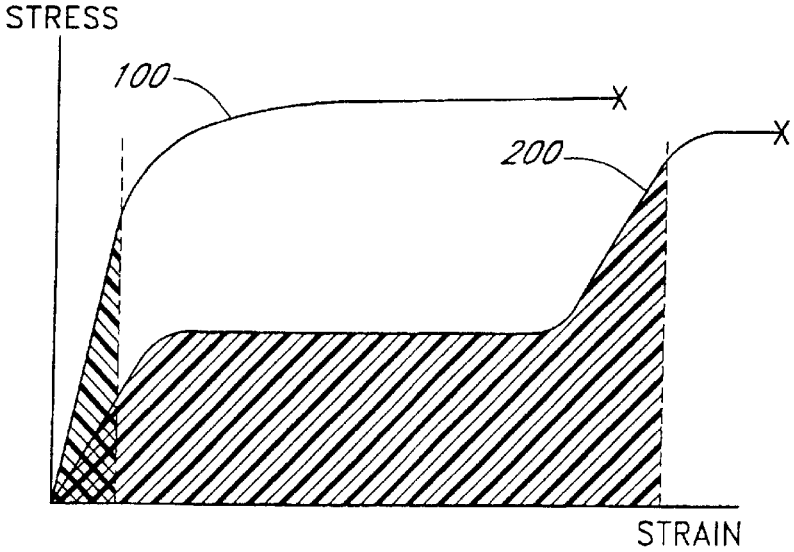
FIG. 3C is a comparative graph of vibrational energy capacity of a string constructed of a superelastic alloy versus vibrational energy capacity of a string constructed of a conventional linear elastic material such as steel.

Once of the immediate advantages that results from forming a vibratory string from a superelastic alloy material is increased energy capacity. FIG. 3C is a comparative graph which illustrates the energy capacity of a NiTi alloy wire versus the energy capacity of a conventional steel wire under the same amount of tension. Because a NiTi alloy wire has much greater elastic elongation recovery (up to 6%), it is able to store and release a significantly greater amount of energy than the steel wire (compare the area under the elastic region of stress-stain curve 200 with the corresponding area under the elastic region of stress-stain curve 100).

As a result, a NiTi alloy string constructed in accordance with the present invention can vibrate with more energy and, therefore, produce more sound output than a steel wire for a given amount of string tension. In addition, because of the ability of NiTi wire to elastically recover large amounts of strain and to absorb and release more energy, strings constructed of NiTi wire are much better able to resist breakage and permanent deformation even when plucked and strained vigorously. Such characteristics are of particular advantage in demanding applications, such as acoustic and electric guitars, banjos and the like.

Tonal Stability and Inharmonicity

Desirably, a vibratory string formed of such wire (or wires) may be suitably tuned and tensioned to be generally within the superelastic range "C." Those skilled in the art will recognize that the fundamental harmonic frequency of such wire strained or tensioned in such manner will be relatively unaffected by gradual or even abrupt changes in the amount of elongation strain, such as may be caused by the aforementioned environmentally-induced changes in the soundboard and surrounding support structures. This is because, in accordance with the stress-strain curve 200 illustrated in FIG. 3B, the amount of stress (tension) on the wire remains generally constant throughout the superelastic region "C". As a result, an instrument, such as a piano, stung with vibratory strings comprising superelastic alloy wires tensioned or strained to within the superelastic range "C" in accordance with the invention, will hold a more constant pitch and, therefore, require less frequent tunings to maintain the instrument in optimal playing condition.

Experiments have also revealed, surprisingly, that a vibratory string comprising a superelastic alloy wire in accordance with the invention and tensioned or strained to be within the superelastic range "C" produces, when suitably struck or plucked, a superior and exceptionally harmonic and resonant tone with little or no undesired disharmonic overtones. The exact explanation for the observed superior tonal qualities and reduced Inharmonicity is not completely understood at this time. There are many factors, many unknown, which influence the particular tonal quality of sound produced by a vibratory string. However, it is believed that the wire being composed of a superelastic alloy, and particularly when it is tensioned or strained to be within the superelastic range "C" as described above, mitigates or eliminates the aforementioned Inharmonicity of higher partials by reducing the bending component of energy storage and transmission within the string and by reducing transient string tension loading caused by vibratory displacement and stretching of the string itself.

An ideal vibratory string has no bending resistance such that the speed of wave propagation along the string is the same for all partials and, thus, all partials are perfectly harmonic. A non-ideal vibratory string, such as a conventional piano wire, has a relatively high elastic modulus of elasticity and thus is relatively stiff and resistant to bending. The amount of bending resistance can be calculated from the elastic modulus of the material, its cross sectional area and its bending moment of inertia. Since higher harmonic partials produce more bending for a given amplitude (e.g., more nodes and anti-nodes) the speed of energy transmission (wave propagation) along such non-ideal string will be faster for higher harmonic partials than for lower harmonic partials due to the additional component of energy transfer through bending. This results in higher partials being slightly sharper than that predicted by the ideal harmonic response. The degree of sharpness will depend on how much of the string vibrational energy is transferred in the form of bending of the string (non-ideal string response) versus stretching of the string (ideal string response).

In addition, when a vibratory string having a high modulus of elasticity is struck, plucked, bowed or otherwise excited, the transient vibratory displacement (and, therefore, stretching) of the string itself can effectively increase the tension of the string and thus increase the pitch of higher harmonic partials. As the string vibrates at the fundamental and lower harmonics it must necessarily increase its length by periodically stretching and contracting as the string moves back and forth and/or rotates during the resulting transient decay. Effectively, this vibration increases the tension on the string and, thus, the speed of wave propagation for higher partials. In contrast, a NiTi wire tensioned to within the superelastic range "C" maintains substantially constant tension regardless of the transient response and, therefore, will reduce Inharmonicity due to transient string tension loading.

It can generally be concluded that relatively high elastic modulus materials will produce more Inharmonicity for a given length and cross-section of wire material than for lower modulus materials. Because a NiTi alloy wire has a relatively low elastic modulus (preferably less than about 90 GPa, more preferably less than about 75 GPa and most preferably less than about 50 GPa), it is less resistant to bending than conventional steel piano wire and therefore, produces a more ideal harmonic response with less Inharmonicity. Optimal reduction of Inharmonicity may be achieved by selecting a string material having the combination of a relatively low modulus of elasticity (ME) and a relatively high ultimate tensile strength (UTS). A ratio below about 50:1 to about 100:1 ME to UTS is preferred with the ratio of below about 40:1 being more preferred and the ratio of below about 20:1 being most preferred.

Experiments have further revealed that unique and pleasant tones may be generated when a vibratory string comprising superelastic Ni—Ti alloy wire in accordance with the invention is tensioned or strained to be near or within either the elastic regions $A_1$ or $A_2$ and suitably struck or plucked. This is believed to be a result of the unique elasticity and vibrational properties of the material in these regions, generally characterized by a relatively low modulus of elasticity (83 GPa versus 205 GPa for steel wire) and a relatively low density (6.45 g/cm$^3$ versus 7.85 g/cm$^3$ for steel wire).

Tuning Vibratory Strings

The selected tuning of vibratory strings formed of a superelastic alloy and tensioned or strained to be within the superelastic region "C" poses additional considerations which merit particular discussion. As noted above, when such a wire is tensioned or trained to be within the superelastic region "C" the tension experienced by the wire remains relatively constant as the superelastic material undergoes a progressive transformation from its austenite crystalline state to its martensite crystalline state. Thus, the tension of the wire cannot be readily adjusted by turning a conventional tuning pin to wind the string onto the pin. However, it has been discovered that tuning using a conventional tuning pin can accomplish tuning within a limited range. Such limited tuning is believed to be facilitated by the actual stretching of the wire itself (without increasing its tension) and the concomitant reduction in its density per unit length.

Thus, the fundamental pitch of a vibratory string formed of a superelastic alloy and tensioned or strained to be within the superelastic region "C" can be tuned within a limited range using a conventional tuning pin, perhaps modified to accommodate larger expected elongation strains. Additional tuning, if needed, can be effected by adjusting or repositioning the bridge to shorten or lengthen the active length of the vibratory string. If the vibratory string is to be used in the elastic regions $A_1$ or $A_2$ illustrated in FIG. 3 a conventional or modified tuning pin should be suitable to accomplish a reasonable range of tuning. Of course, such vibratory strings can also be tuned as is well known in the art by selecting appropriate diameter wire and/or by coating or winding the wire with other suitable materials such as copper, gold or silver to obtain a desired density per unit length.

Alternatively, and in accordance with another preferred embodiment of the present invention a hybrid vibratory string may be provided comprising a plurality of wires or filaments bundled, braided, wound, or rolled together wherein at least one or more of the wires or filaments is formed of a material having a substantially linear elastic compliance characteristic. As another example, a "filled" NiTi wire may also be provided comprising a core material of carbon steel or other linear elastic material contained within an outer sleeve of NiTi tubing. If desired, the core may be selected to have magnetic properties such that the string may be used in conjunction with the magnetic pick-up of an electric guitar. Such magnetically opaque NiTi alloy wires are commercially available for medical use in MRU imaging and similar applications.

For the case of the hybrid string, those skilled in the art will recognize that the overall tension of the hybrid string will be equal to the sum of the multiple tension components attributable to each individual wire or filament. Accordingly, such a hybrid vibratory string will exhibit desirable characteristics of both a superelastic alloy in its superelastic state as well as desirable characteristics of a conventional linear elastic material in the elastic compliance region. More specifically, the vibratory string when tensioned or strained to the superelastic state, would continue to increase its tension (albeit at a slower rate) as it is further strained. This would facilitate a wider range of tuning ability using a conventional tuning pin, while still preserving many of the advantages heretofore discussed. Similarly, a multi-wire or multi-filament vibratory string may be formed from two or more different wires or filaments of superelastic alloy materials, having different stress/strain compliance characteristics, in order to provide a gently upward sloping stress-strain compliance characteristic in the resultant string when tensioned or strained to the superelastic state. This is in contrast to the essentially flat or constant stress compliance characteristic illustrated in the region "C" of FIG. 3A. Alternatively, a hybrid string may be formed by joining a length of NiTi wire to a length of steel wire in an end-to-end fashion.

Temperature Effects

While NiTi wires are generally found to be tonally stable over long periods of time, the pitch of a tensioned NiTi wire (depending on the particular amount of tension applied) can be affected by temperature changes. Surprisingly, however, the temperature response for a NiTi wire is completely reverse to what one normally finds with a vibratory string constructed of conventional materials such as carbon steel. Conventional vibratory strings universally go down in pitch with increasing temperature. Strings constructed of NiTi wire are found to go up in frequency with increasing temperature and vice versa. This phenomena is a result of temperature effects on stress-induced formation of martensite above the alloy's normal transformation temperature. In particular, as the ambient temperature moves further away from the transition temperature, stress-induced martensitic transformation is more difficult and the alloy tends to revert to its less elastic austentitic crystalline state. The exact temperature relationship depends upon the particular alloy material used and the amount of tension applied.

It has been discovered, moreover, that by adjusting the tension of a NiTi wire string and/or by combining NiTi alloy(s) and conventional string materials together, it is possible to construct a vibratory string having a completely neutral temperature response or, in other words, a vibratory string having an effective thermal expansion coefficient of or about 0.0/° C. Such a string would be most useful in applications requiring high tonal stability under changing ambient conditions.

One way that such temperature neutral string can be constructed is by joining a length of NiTi wire to a length of steel wire. Preferably, the steel wire would comprise the active length of the vibratory string, while the NiTi wire would be disposed between the bridge and the hitch pin of a piano, for example. The string would then be tensioned so that the NiTi portion is within the superelastic region "C" as described above. This maintains the tension of the active string portion substantially constant due to the flat stress-strain curve of the NiTi wire in this region. The relative lengths of NiTi and steel wires are further selected such that the natural thermal expansion of the steel wire with increasing temperature is approximately cancelled by the contraction of the NiTi wire due to reduction of stress-induced martensitic transformation (see, e.g., FIG. 16 and the accompanying text herein).

Figure 15:
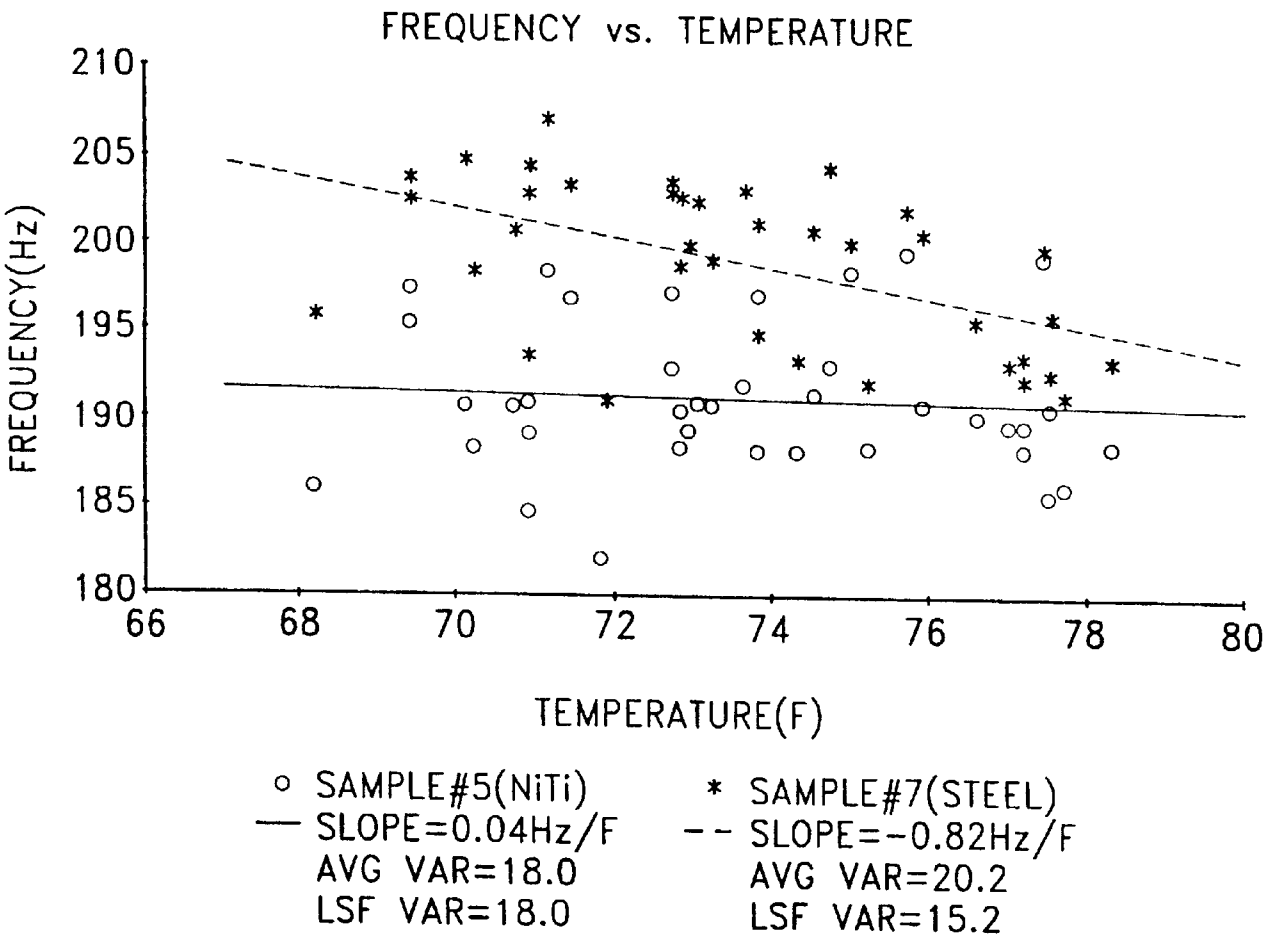

Another possible way to create a temperature neutral string is to take a NiTi wire and tension it to the point where the natural thermal expansion of the NiTi wire itself ($\sim 1.0\times 10^{-6}/°$ C.) is approximately cancelled or balanced by the contraction of the NiTi wire due to the aforementioned reduction of stress-induced martensitic transformation (see, e.g., FIG. 15 and the accompanying text herein).

Pitch Regulation

Alternatively, or in addition to the particular embodiments of the invention described above, the pitch of a vibratory string constructed of NiTi and/or other materials can be actively or regulated, either electronically or otherwise, so as to provide even more pitch stability and control. This may be accomplished, for example, using any one of a number of known temperature control techniques, such as ambient heating/cooling of an indoor environment where the instrument resides and/or by temperature regulation of the inner case of the musical instrument itself or a portion thereof using a suitable heat source such as an electric resistance heater. Such heaters for acoustic pianos are well known and commercially available from any one of a number of sources.

Figure 6:
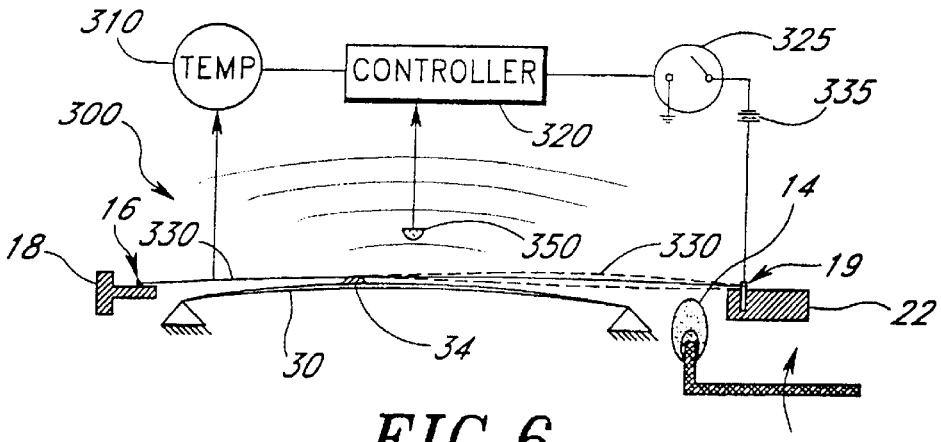
FIG. 6 is a simplified schematic diagram of an electronic string tension control system having features in accordance with the present invention.

Alternatively, if more precise temperature control is desired an electrical current may be selectively passed through each vibratory string, either individually in succession by means of a suitable current or voltage source and an electronic switch or variable impedance device(s), or in parallel using a voltage or current source and one or more suitable resistive ballast elements or variable impedance devices, or some combination of these techniques. Accordingly, each wire is heated due to its electrical resistance to the current. If desired, closed-loop control may be provided, as illustrated in FIG. 6, by temperature sensing and feedback using a suitable temperature sensing element 310 (e.g., a thermal-couple, thermal-resistive element, or infrared sensor) and control circuitry 320 (e.g., a suitably programmed micro-computer chip or CPU) to selectively apply current or voltage from a source 335 to a string 330 via an electronic switch or variable impedance 325. Such closed-loop temperature sensing and control system 300 can regulate the ambient temperature within the musical instrument, for example, or it can regulate the temperature of each vibratory string 330 individually, as desired. Simple passive control systems can also be implemented to the same effect using known mechanical and/or electrical sensing and control elements.

Even more sophisticated active or passive control systems can be implemented, if desired, to provide optimal tonal stability of an acoustic instrument. For example, a closed-loop feedback control circuit can be readily implemented using well-known sensing and control techniques to periodically sense or measure the fundamental harmonic of each vibratory string 330, such as via a piezoelectric sensor or microphone 350 and adjust the temperature of the string 330 by heating or cooling to raise or lower the fundamental harmonic to the desired pitch. Alternatively, such control system may similarly adjust the pitch of each vibratory string by automatically adjusting the tension or active length of the string using a suitable mechanical transducer.

Those skilled in the art will further recognize that many of the above-described examples and techniques may be advantageously implemented in acoustic instruments strung with conventional vibratory strings, such as carbon steel wire. These may be used, for example, if the overall tone and quality of a conventional steel wire is desired. Thus the examples and techniques described above may be used to achieve more accurate and/or stable tension or tonal regulation.

Again, it is also possible to combine the benefits of conventional music wire with wire formed from a superelastic alloy by splicing or joining together two lengths of such wires to form a single vibratory string. In such case, preferably the splice point is not within the active length of the vibratory string so as not to unnaturally distort the tonal qualities of the string. For example, such a hybrid string may be formed by joining a length of Ni—Ti wire to a length of steel wire whereby the steel wire forms the active length of the vibratory string and the Ni—Ti wire comprises an inactive or collaterally active length disposed, for example, between the hitch pin and the bridge of the instrument. In this manner, the Ni—Ti wire portion can be optimally selected and strained to its superelastic state to provide tension regulation of the active string length. Alternatively, if the active length of the vibratory string is to comprise two or more portions of dissimilar wire (i.e. the splice point is within the active length), then it is desirable to select and balance the wires so that they have approximately equal elasticity and density per unit length in order to assure pleasant tonal and harmonic qualities.

Figure 7A:
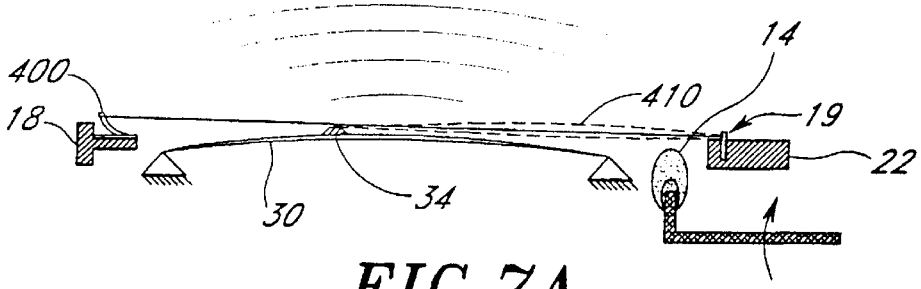
FIGS. 7A–C are schematic diagrams illustrating various string tension regulation elements having features in accordance with the present invention.
Figure 7B:
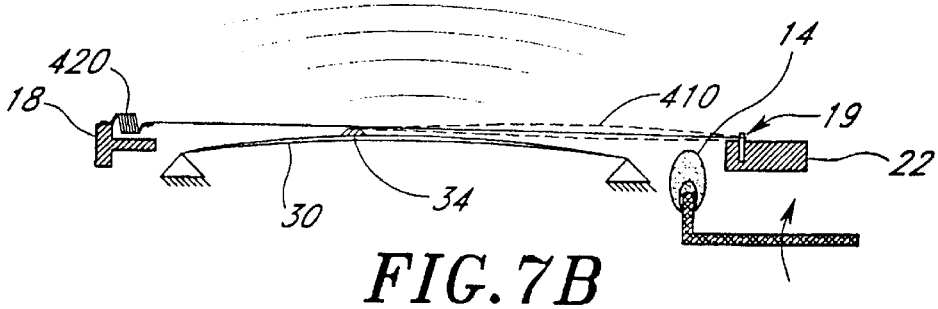
Figure 7C:
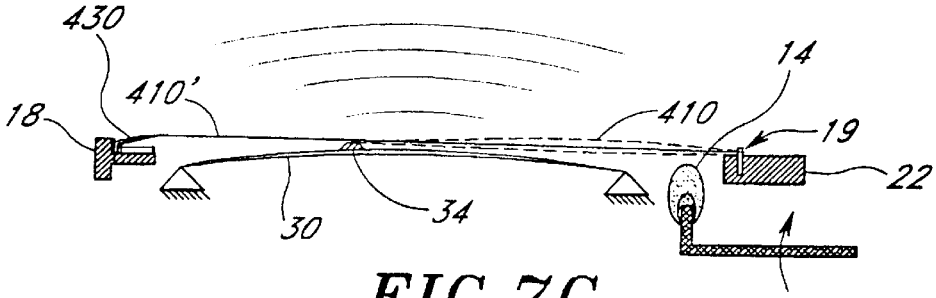

Similarly, tension regulation of a conventional vibratory string may also be accomplished by providing a simple tension regulating element formed of a superelastic alloy material tensioned, compressed or otherwise strained to its superelastic state and being provided in mechanical communication with the vibratory string. Such element may be provided, as illustrated in FIGS. 7A and 7B for example, in the form of a Ni—Ti spring element 400, 420 suitably selected and formed and being secured between the hitch pin or harp of the instrument and the vibratory string 410. Alternatively, such element may comprise a similar spring element 430 suitably selected and formed and being positioned adjacent to and bearing against the tensioned vibratory string preferably along an inactive length 410' thereof Again, those skilled in the art will recognize that such a tension regulating element being formed of a superelastic material and strained to its superelastic state will provide tension regulation of the active string length 410. The particular size, shape, configuration and location of the tension regulating element 400, 410, 430 is not particularly important, but will be governed by the particular application, the amount of tension on the associated vibratory string and degree of tension regulation desired.

EXAMPLES

Several examples are described below using various selected NiTi alloy string materials as generally described herein. In each example, a subject string of approximately 75–100 cm in length was secured to a test bench comprising a fixed hitch pin and a tuning pin spaced approximately 50 cm apart. A sound board was provided immediately beneath the string with a fixed bridge element bearing against the string about 10 cm from the fixed hitch pin. The string was tensioned in accordance with the particular experiment to produce a desired pitch. The pitch was thereafter measured periodically over the course of approximately one month using an electronic microphone and digital sampling software. The pitch was recorded along with the ambient temperature within the test room. APPENDIX "A" attached hereto contains the raw recorded data, which was used to generate the various graphs and other reported information contained in FIGS. 8–16.

TABLE 5 below provides a list of the sample string materials that were constructed and tested in accordance with the present invention.

TABLE 5

| Sample | Material | Diameter |
|---|---|---|
| #1 | NiTi (Chrome Doped) | 0.305 mm |
| #2 | NiTi (Alloy N/Af = 12 C.) | 0.411 mm |
| #3 | NiTi (Chrome Doped) | 0.457 mm |
| #4 | NiTi (Alloy N/Af = 12 C.) | 0.584 mm |
| #5 | NiTi (Alloy N/Af = 12 C.) | 0.760 mm |
| #6 | Steel (prior art) | 0.450 mm |
| #6A | Steel (#6)/NiTi (#4) | 0.450 mm |
| #7 | Steel (prior art) | 0.550 mm |

Figure 8:
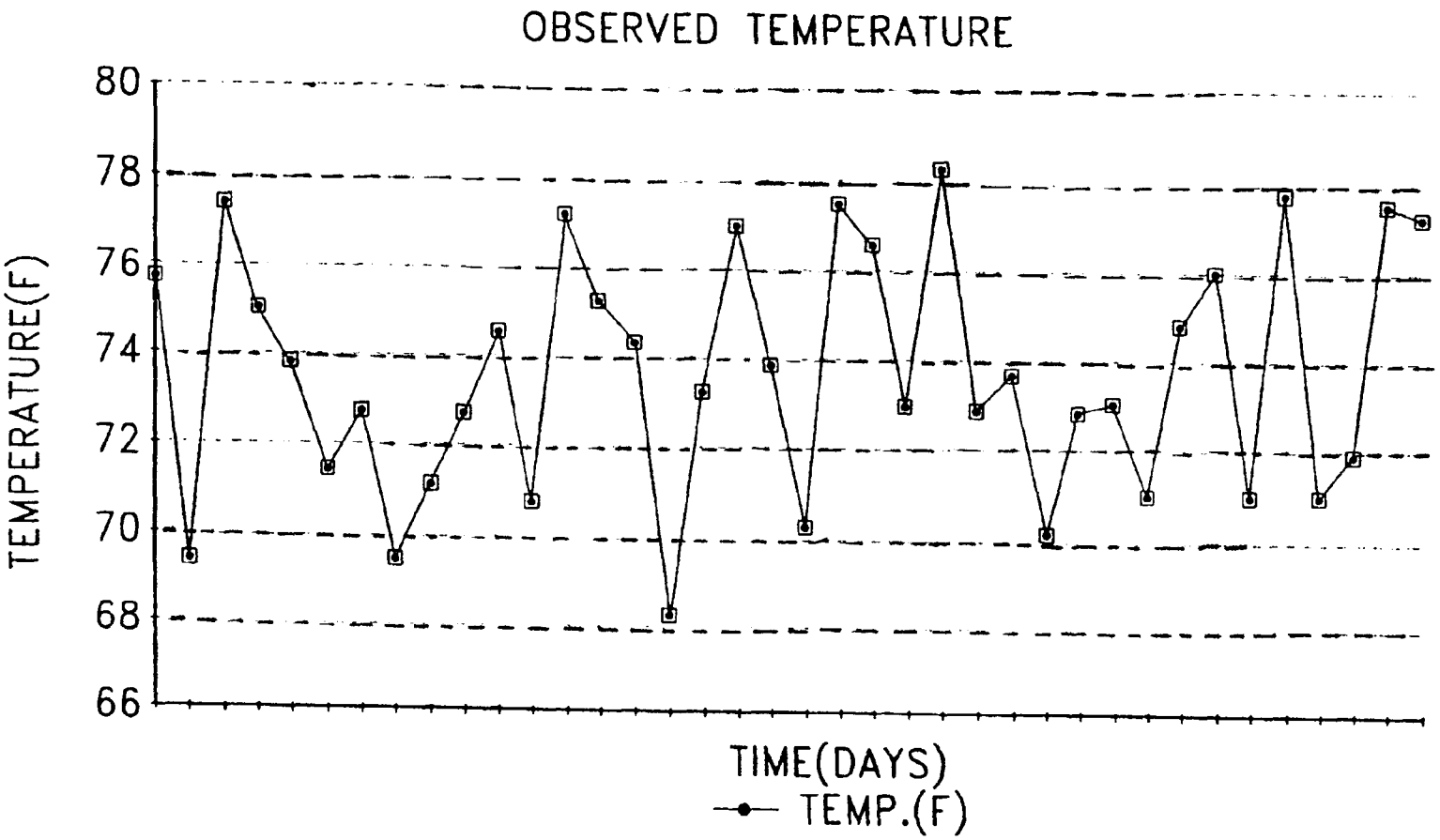
FIG. 8 is a graph of observed temperature versus time.

FIG. 8 is a graph of observed temperature versus time for each of the examples discussed herein. The temperature generally varied between about 68 and 78° F. (20–26° C.) during the course of the experimentation. The various examples described below were constructed and all experimentation was carried out in an enclosed room having no ambient air temperature control. Thus, the temperature was allowed drift with the outdoor air temperature.

Figure 9:
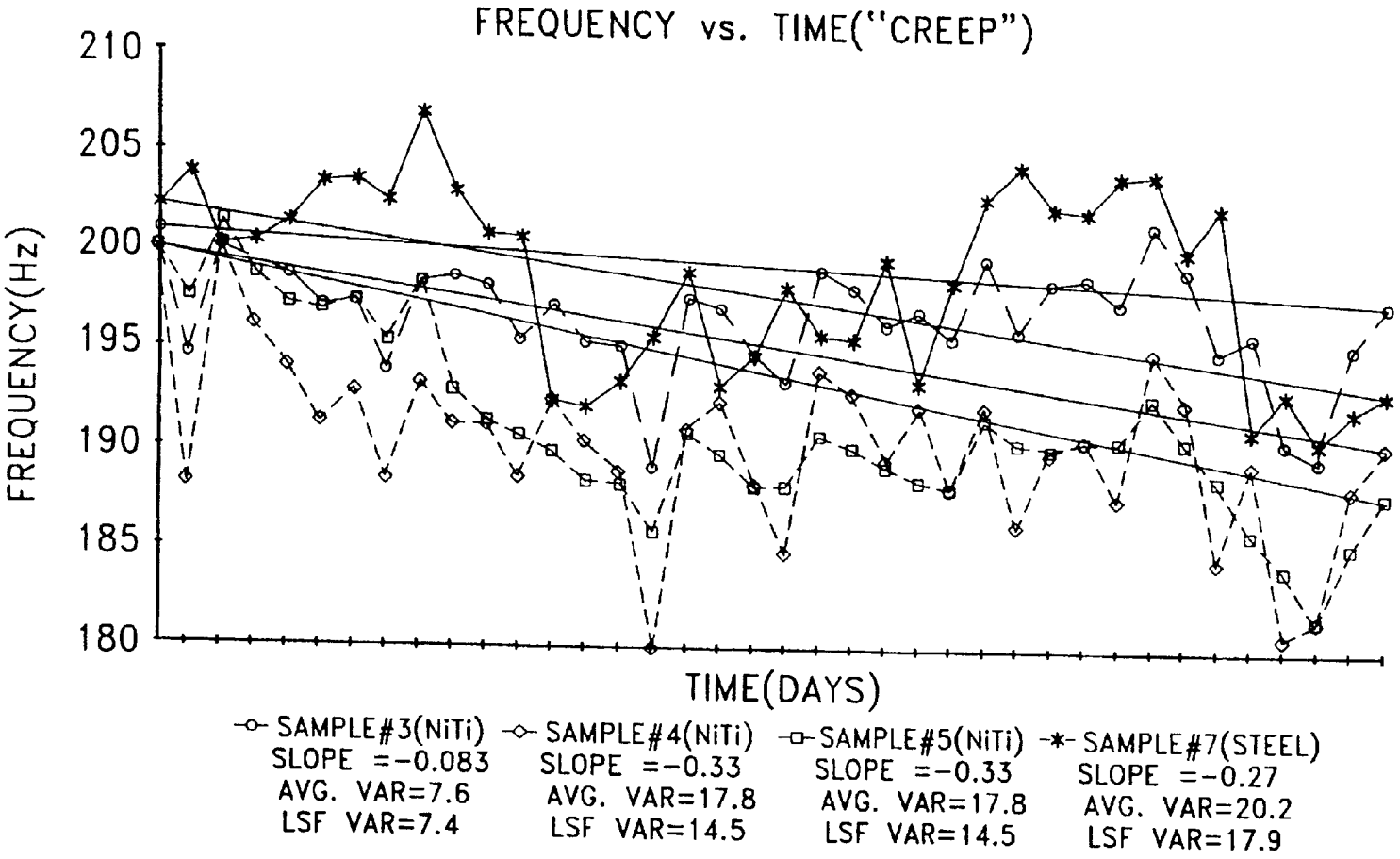
FIG. 9 is a comparative graph of measured frequency versus time for NiTi wire samples #3, #4 and #5 compared to prior art steel wire sample #7.

FIG. 9 is a comparative graph of measured frequency versus time for NiTi wire samples #3, #4 and #5 compared to prior art steel wire sample #7. The trend lines represent a least-squares-fit (LSF) to the indicated data. The slope of each trend line is indicated and represents the average frequency creep of creep over time. The statistical mean variance of the data (AVG VAR) and the statistical variance from the LSF trend line of the data (LSF VAR) are indicated for each sample. This figure illustrates that string sample #3 (NiTi) had the least amount of creep over time, with an average slope of about minus 0.083 Hz/day.

Figure 10:
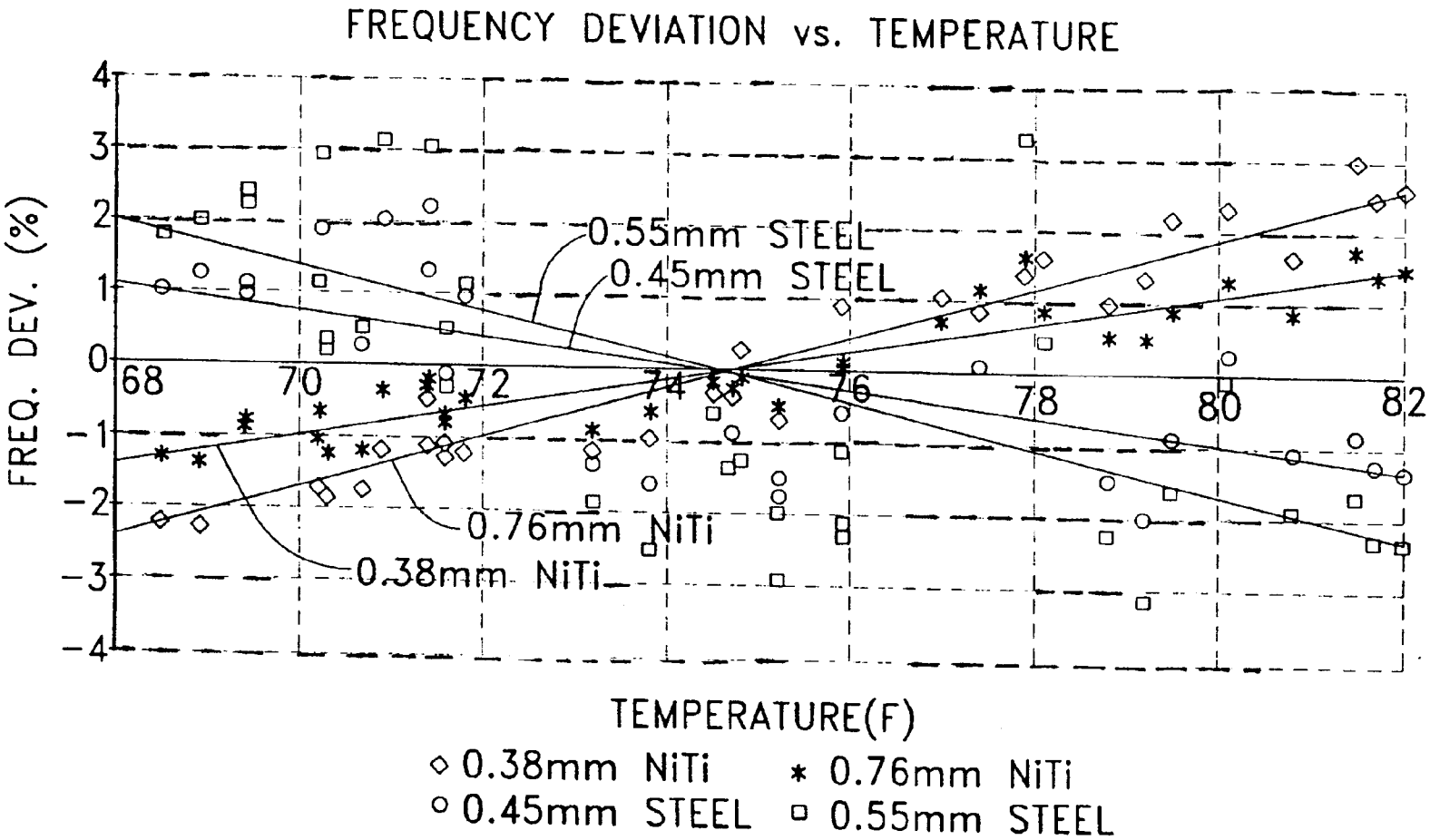
FIG. 10 is a comparative graph of frequency deviation versus temperature for selected samples of NiTi wire compared to selected samples of prior art steel wire.

FIG. 10 is a comparative graph of frequency deviation versus temperature for selected samples of NiTi wire compared to selected samples of prior art steel wire. Again, the trend lines represent a least-squares-fit (LSF) to the indicated data. The slope of each trend line is indicated and represents the average amount of frequency-temperature dependence. It is interesting to note that the NiTi string samples had positive temperature dependence, while the steel string samples indicated the normally expected negative temperature dependence.

As noted above, this phenomena results from temperature effects on the stress-induced formation of martensite above the alloy's normal transformation temperature. In particular, as the ambient temperature moves further away from the transition temperature, stress-induced martensitic transformation is more difficult and the alloy tends to revert to its less elastic austentitic crystalline state. The exact temperature relationship depends upon the particular alloy material used and the amount of tension applied.

FIGS. 11–16 are comparative graphs illustrating measured frequency versus measured temperature for NiTi samples #1–5 and #6A versus steel samples #6 and #7. In each case, the trend lines represent a least-squares-fit (LSF) to the indicated data. The slope of each trend line is indicated and represents the average amount of frequency-temperature dependency. The statistical mean variance of the data (AVG VAR) and the statistical variance from the LSF trend line of the data (LSF VAR) are indicated for each sample tested.

Figure 11:
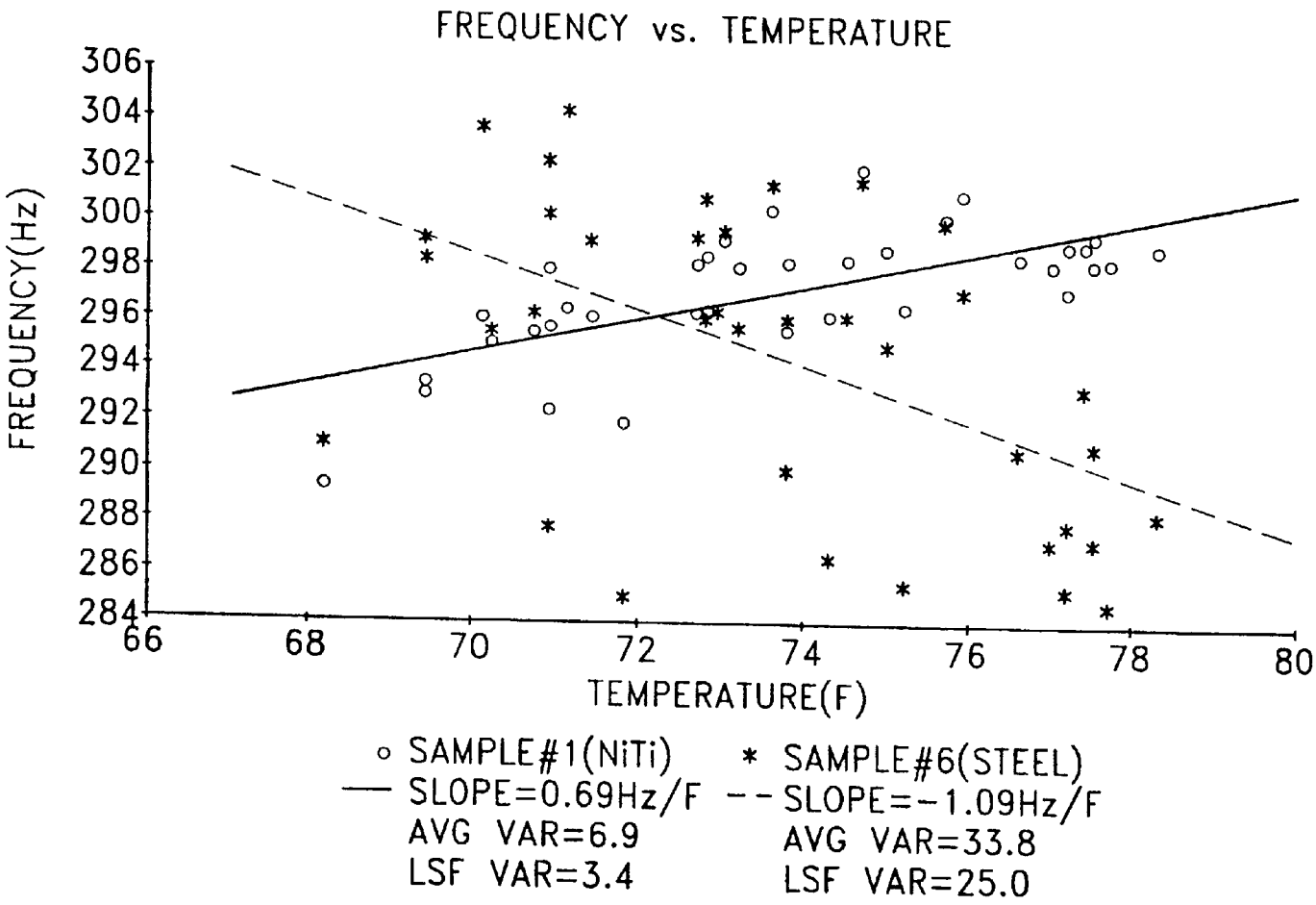
FIGS. 11–16 are comparative graphs illustrating measured frequency versus measured temperature for NiTi samples #1–5 and #6A versus steel samples #6 and #7.

FIG. 11 illustrates the temperature response of sample #1 (NiTi) compared to that of sample #6 (Steel). The data indicates that the steel wire has a negative temperature dependence while the NiTi wire has a positive temperature dependence. Moreover, the average variance (AVG VAR) of the NiTi wire was 6.9 compared to an average variance of 33.8 for the steel wire sample. This indicates that the NiTi wire is able to hold a more constant pitch with changing ambient temperature. The LSF variance (LSF VAR) for NiTi was 3.4 versus 25.0 of the steel wire. This indicates that the temperature response was more linear and predictable for NiTi versus steel. This difference is believed to be caused by the NiTi wire being stretched to its superelastic state so that it was unaffected by changes in the sound board and other supporting structure.

Figure 12:
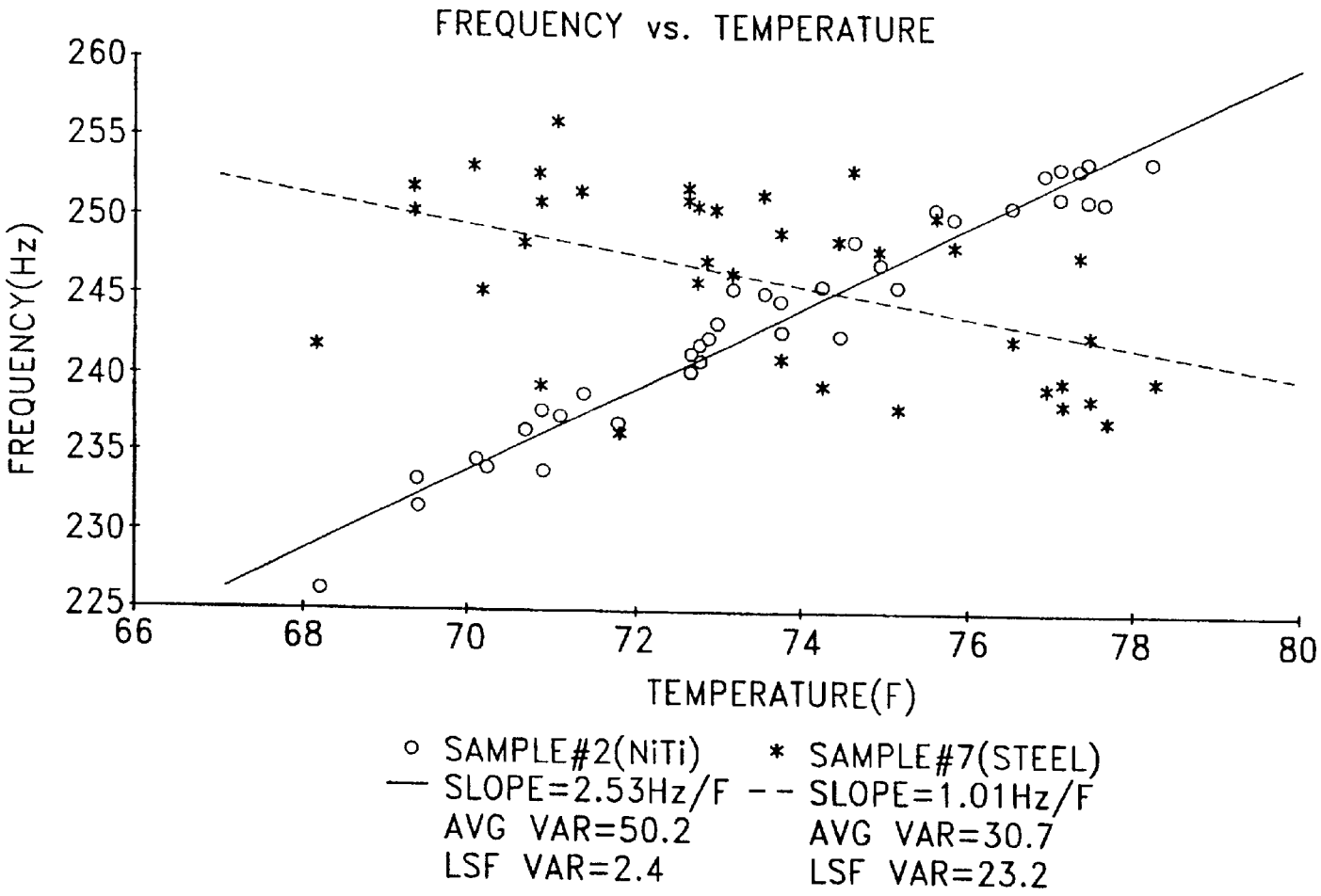

FIG. 12 illustrates the temperature response of sample #2 (NiTi) compared to that of sample #7 (Steel). The data again indicates that the steel wire has a negative temperature dependence while the NiTi wire has a positive temperature dependence. In this case, the average variance (AVG VAR) of the NiTi wire was 50.2 compared to an average variance of 30.7 for the steel wire sample. On the other hand, the LSF variance (LSF VAR) for the NiTi sample was 2.4 versus 23.2 for the steel wire. Again, this indicates that the temperature response was much more linear and predictable for the NiTi sample versus the steel sample.

Figure 13:
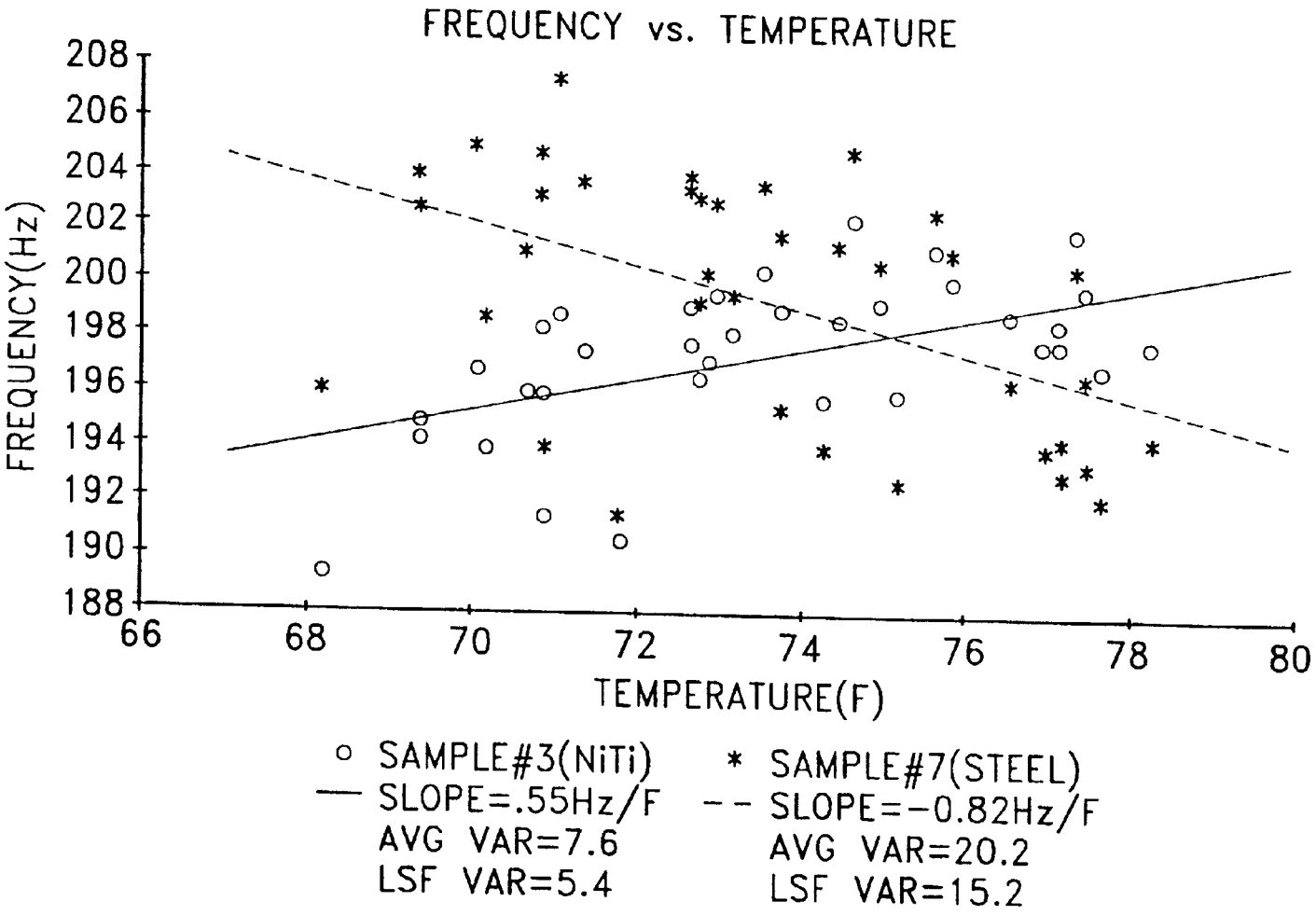

FIG. 13 illustrates the temperature response of sample #3 (NiTi) compared to that of sample #7 (Steel). The data again indicates that the steel wire has a negative temperature dependence while the NiTi wire has a positive temperature dependence. In this case, the average variance (AVG VAR) of the NiTi wire was 7.6 compared to an average variance of 20.2 for the steel wire sample, indicating that the NiTi wire sample held more constant pitch with temperature change. The LSF variance (LSF VAR) for the NiTi sample was 5.4 versus 15.2 for the steel wire, again indicating that the temperature response was much more linear and predictable for the NiTi sample versus the steel sample.

Figure 14:
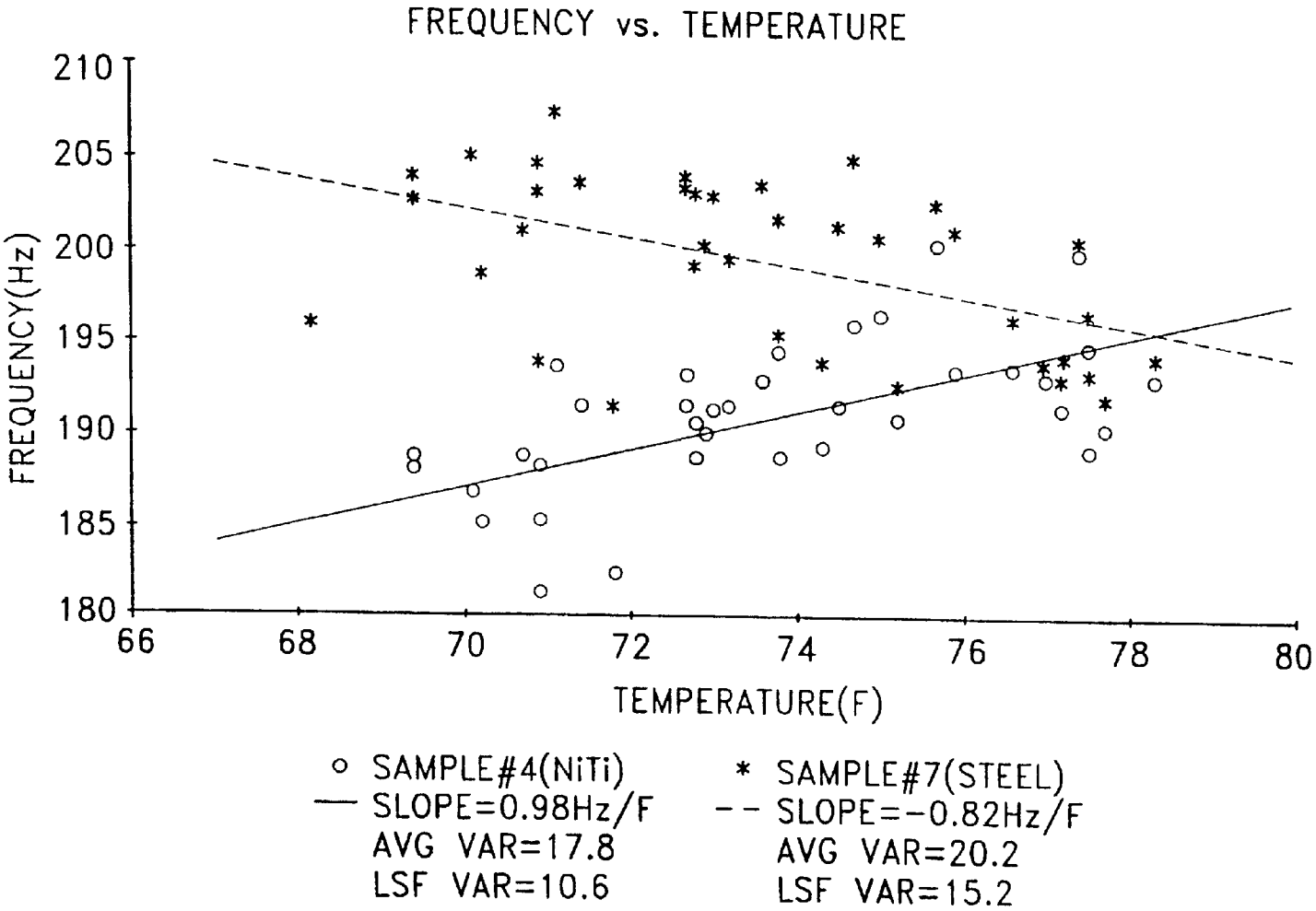

FIG. 14 illustrates the temperature response of sample #4 (NiTi) compared to that of sample #7 (Steel). The data again indicates that the steel wire has a negative temperature dependence while the NiTi wire has a positive temperature dependence. In this case, the average variance (AVG VAR) of the NiTi wire was 17.8 compared to an average variance of 20.2 for the steel wire sample, indicating that the NiTi wire sample held more constant pitch with temperature change. The LSF variance (LSF VAR) for the NiTi sample was 10.6 versus 15.2 for the steel wire, indicating that the temperature response was much more linear and predictable for the NiTi sample versus the steel sample.

FIG. 15 illustrates the temperature response of sample #5 (NiTi) compared to that of sample #7 (Steel). In this case, the data indicates that the NiTi wire has an almost neutral temperature response corresponding to an effective coefficient of thermal expansion of about −0.04° C. It is believed that this particular NiTi alloy and the tension exerted on it were such that the natural thermal expansion of the NiTi wire itself (~$11.0\times10^{-6}$° C.) approximately cancelled out or balanced by the contraction force of the NiTi wire due to the reduction of stress-induced martensitic transformation. The average variance (AVG VAR) of the NiTi wire was 18.0 compared to an average variance of 20.2 for the steel wire sample, indicating that the NiTi wire sample held somewhat more constant pitch with temperature change. The LSF variance (LSF VAR) for the NiTi sample was 18.0 versus 20.2 for the steel wire, indicating that the temperature response was somewhat more linear and predictable for the NiTi sample versus the steel sample.

Figure 16:
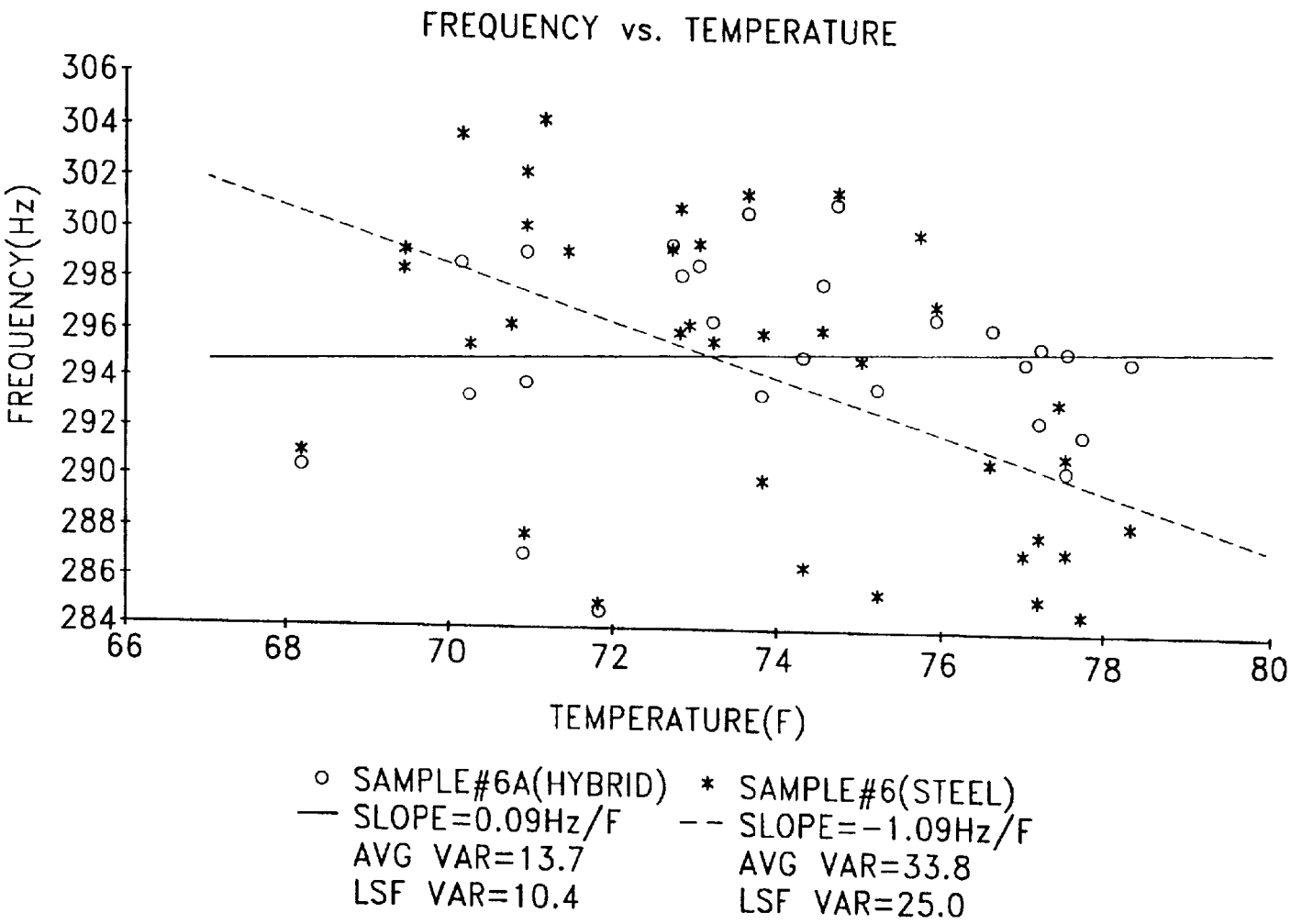
Figure 17:
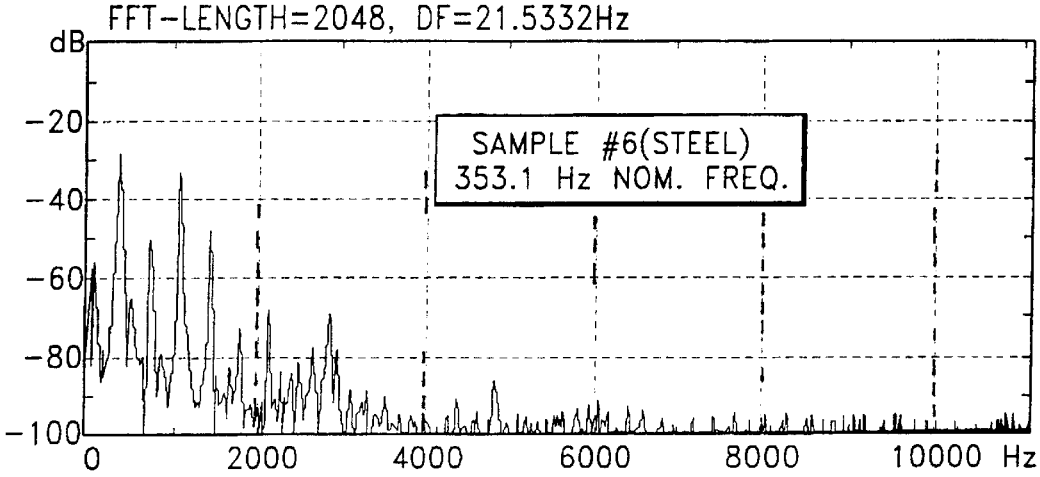
FIGS. 17–24 are graphs illustrating measured frequency spectral responses for NiTi wire samples #1–6A and prior art steel wire samples #6 and #7.
Figure 18:
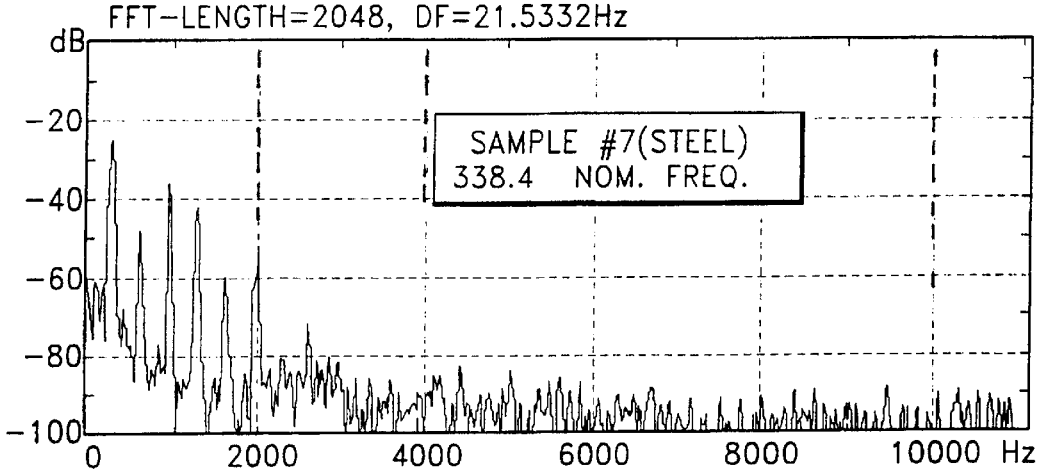
Figure 19:
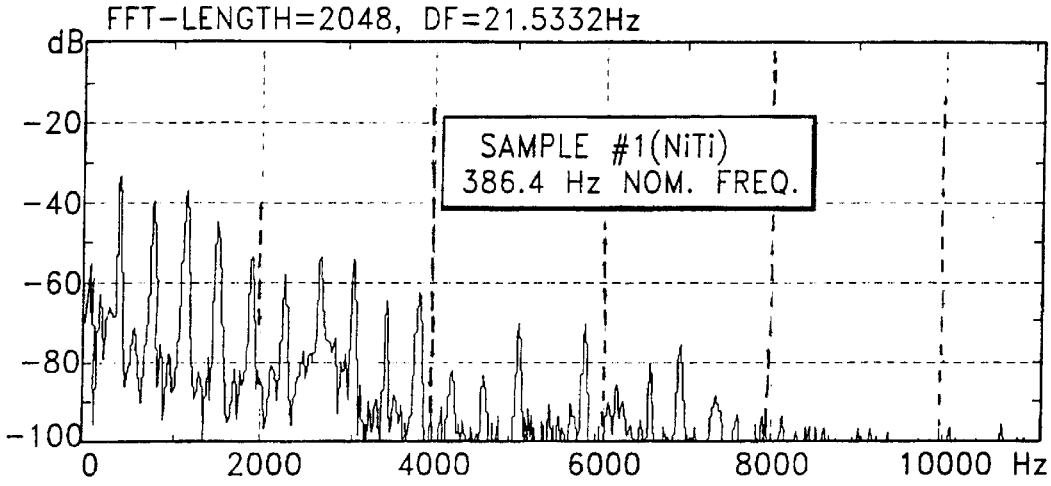
Figure 20:
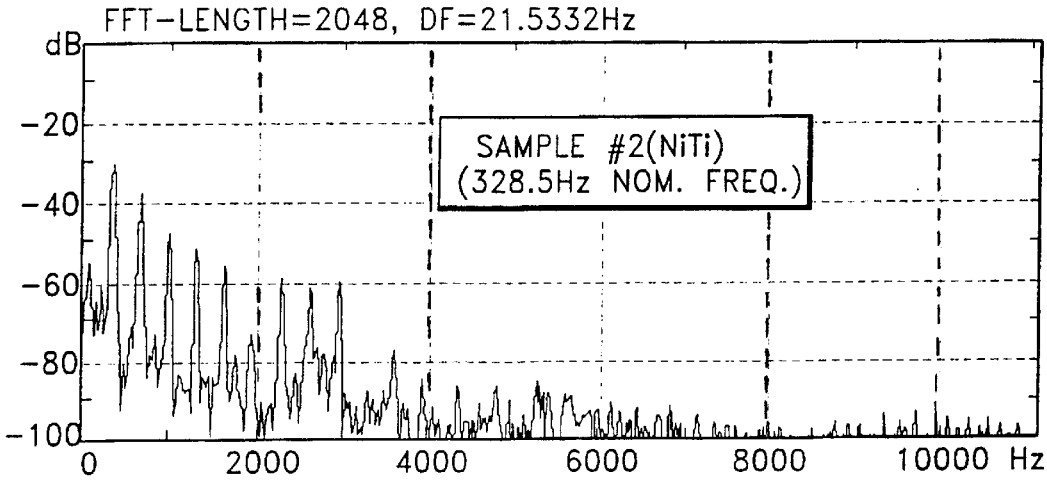
Figure 21:
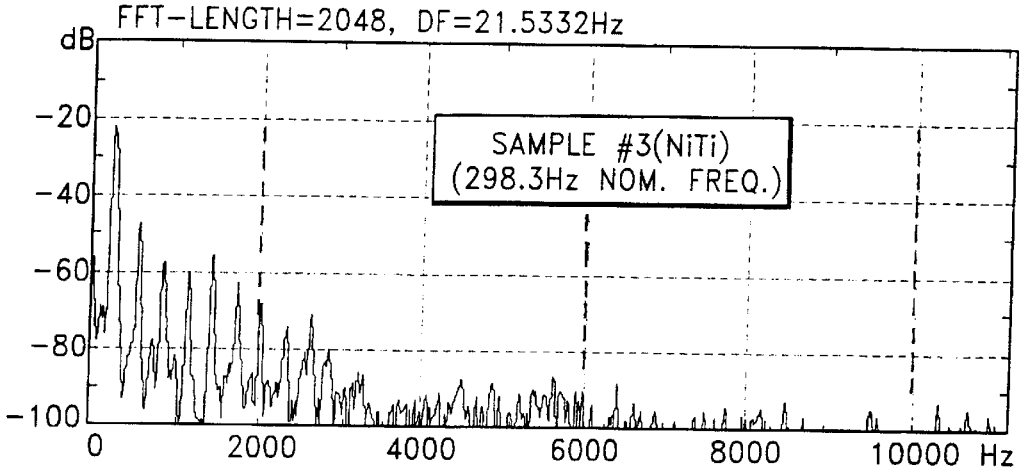
Figure 22:
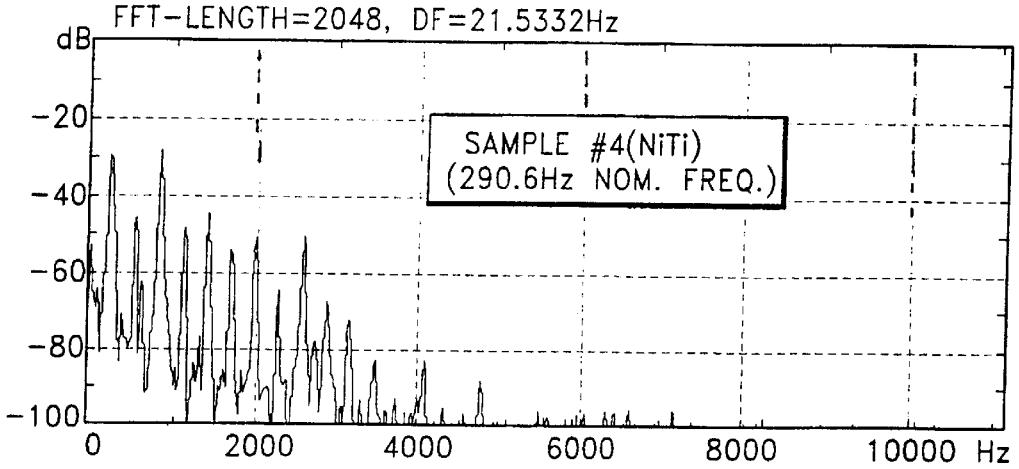
Figure 23:
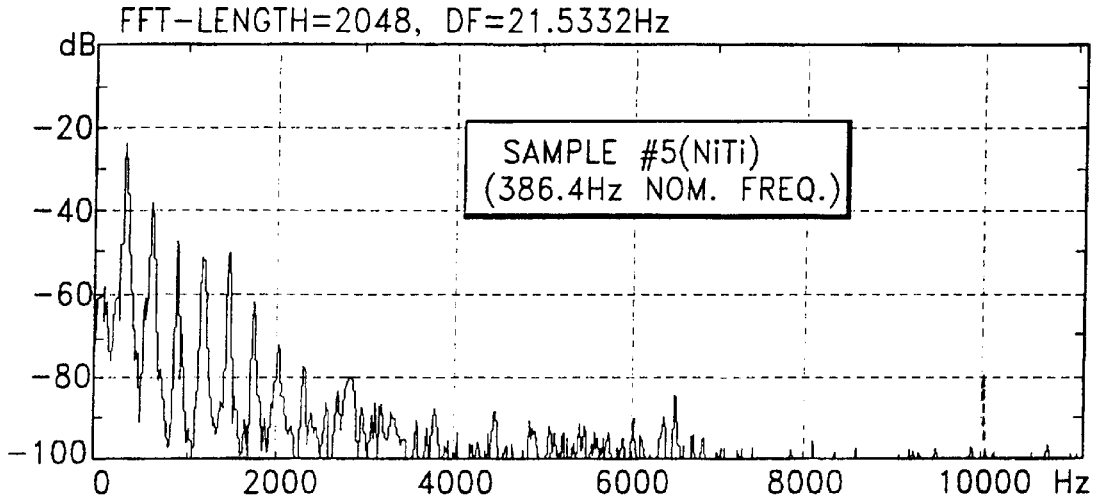
Figure 24:
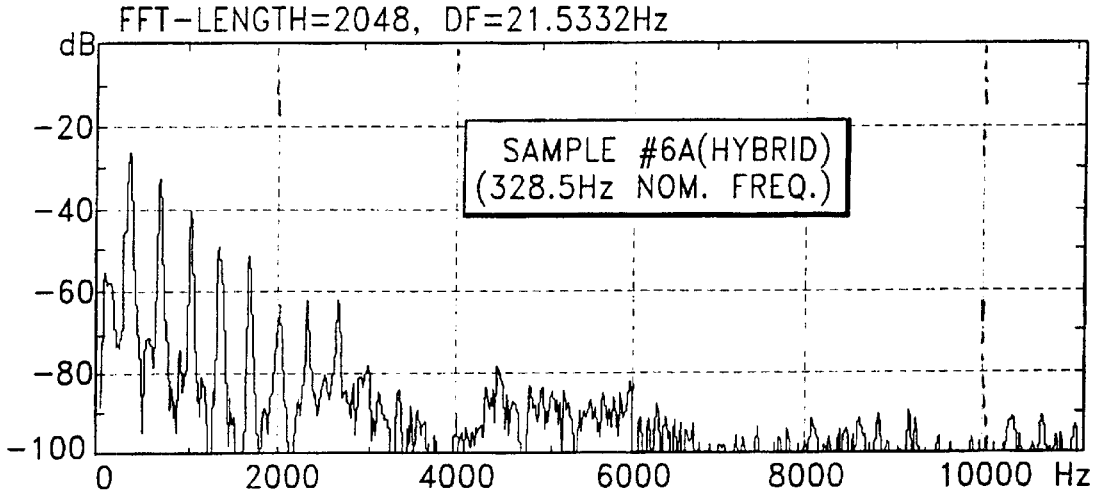
Figure 25:
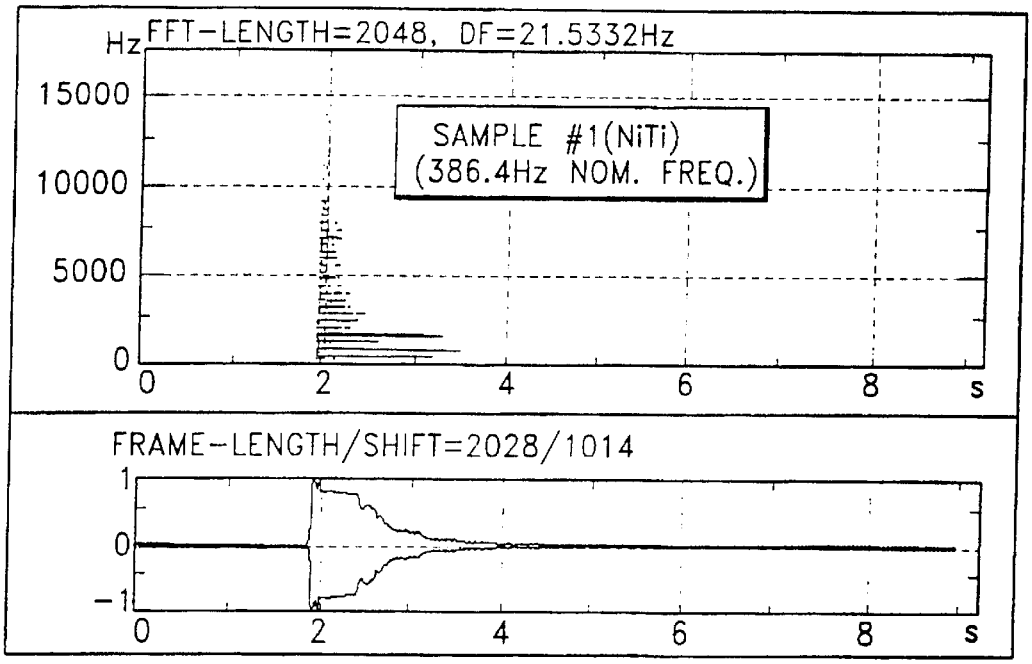
FIGS. 25–32 are graphs illustrating measured vibratory decay responses for NiTi wire samples #1–6A and prior art steel wire samples #6 and #7.
Figure 26:
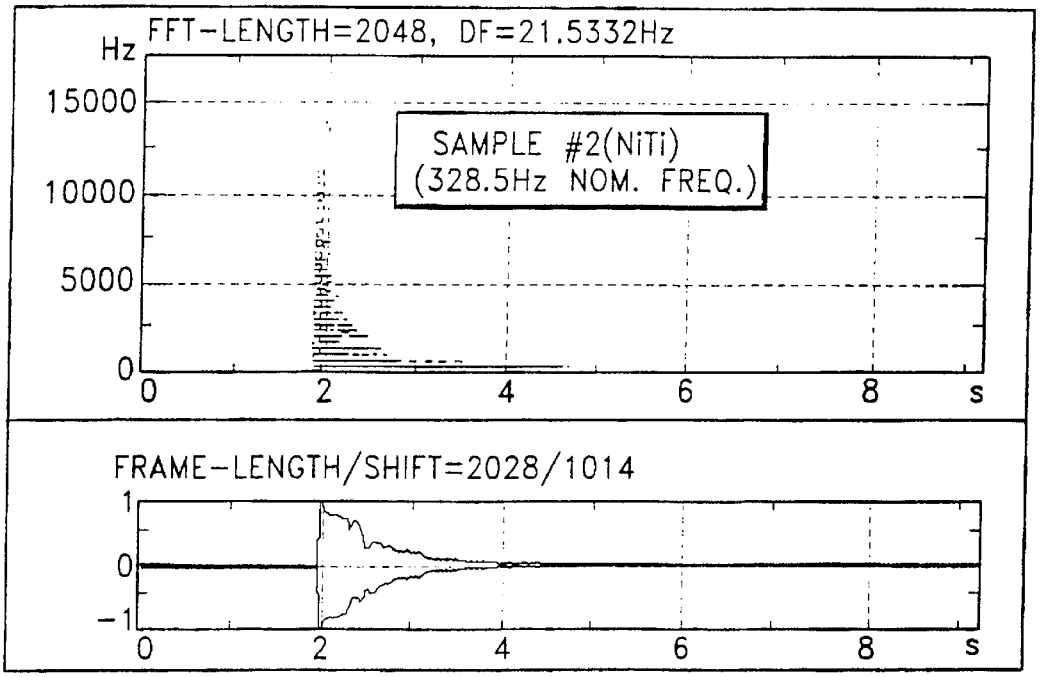
Figure 27:
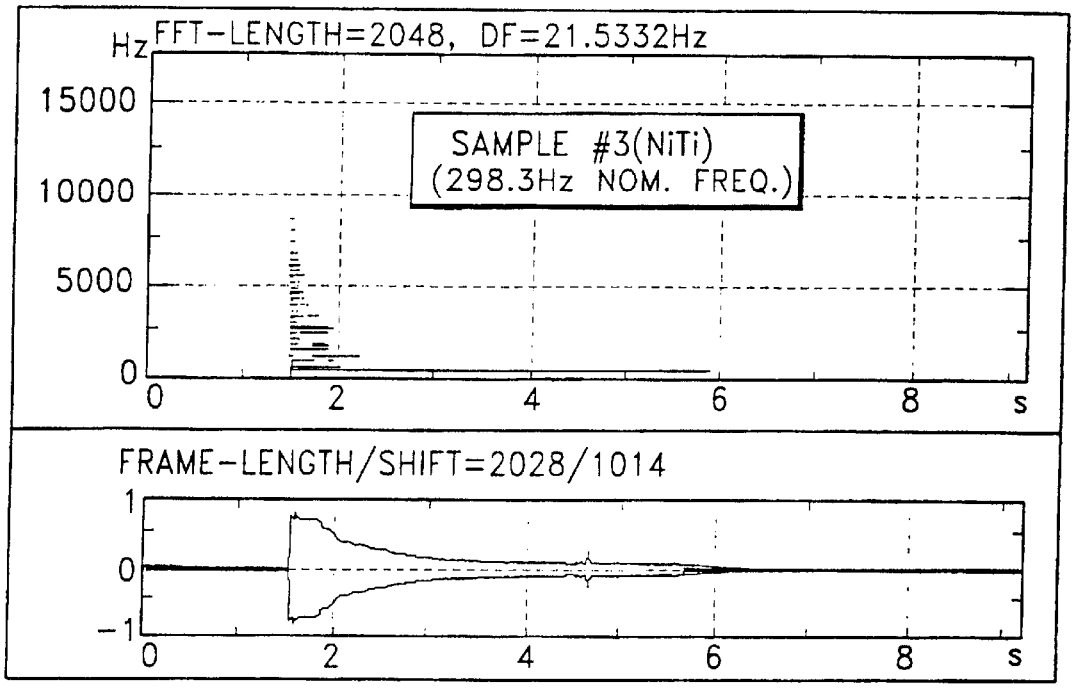
Figure 28:
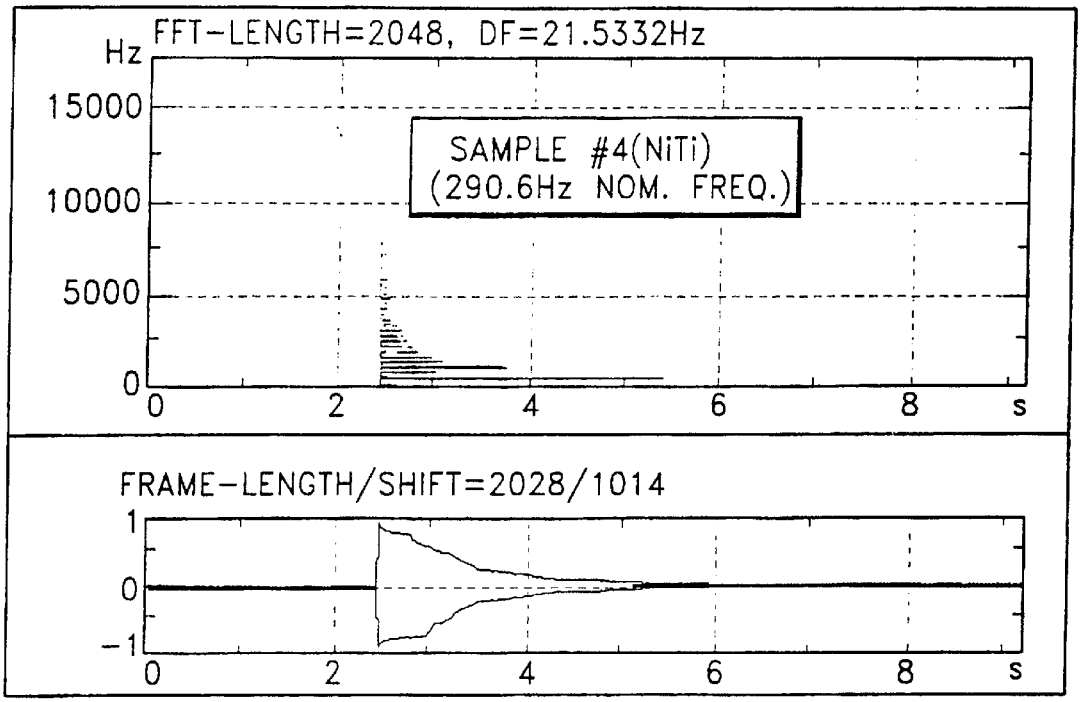
Figure 29:
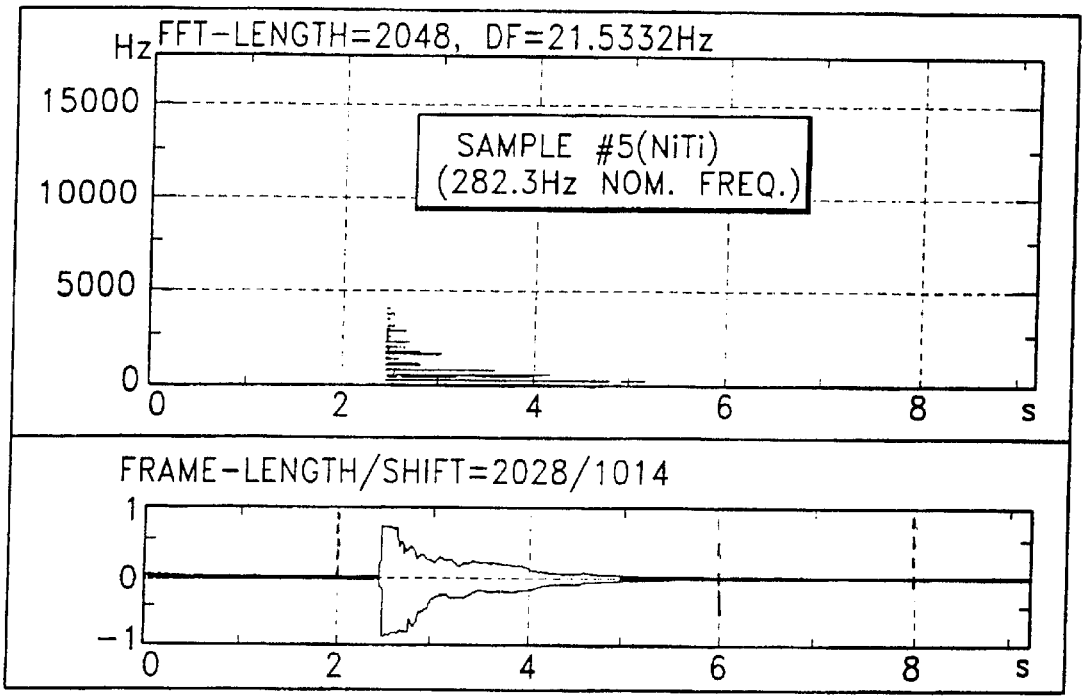
Figure 30:
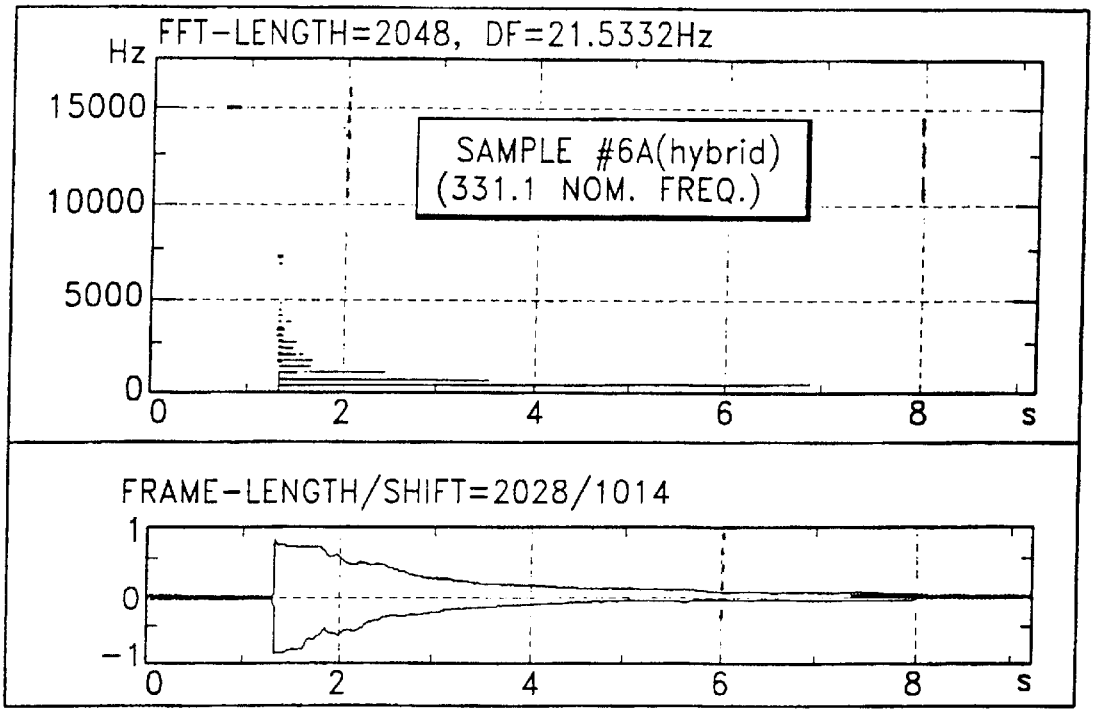
Figure 31:
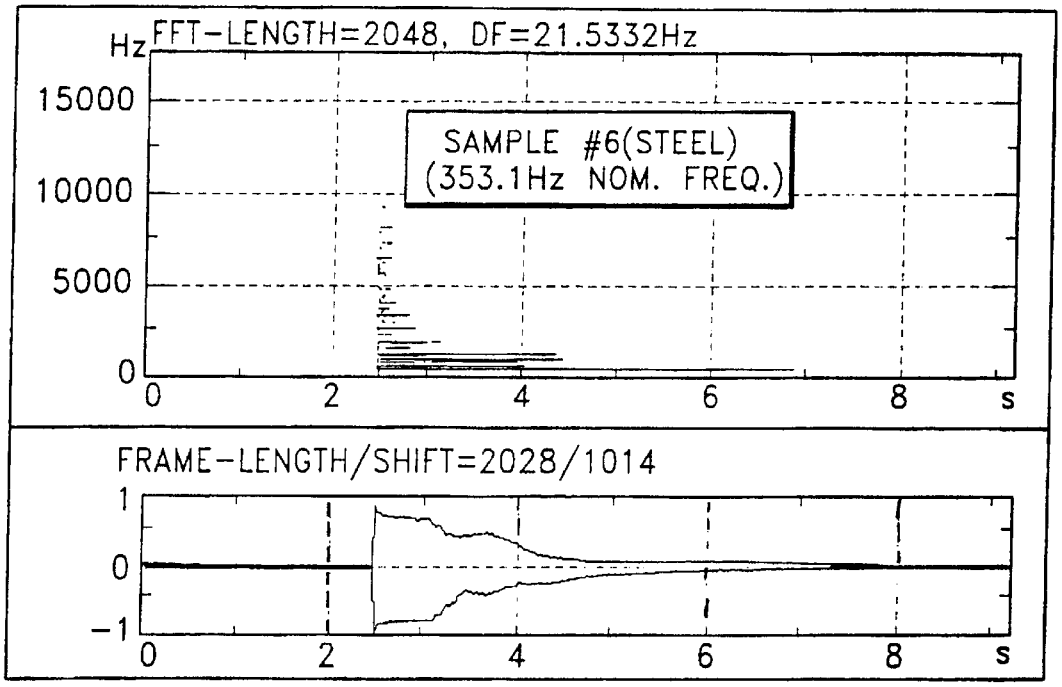
Figure 32:
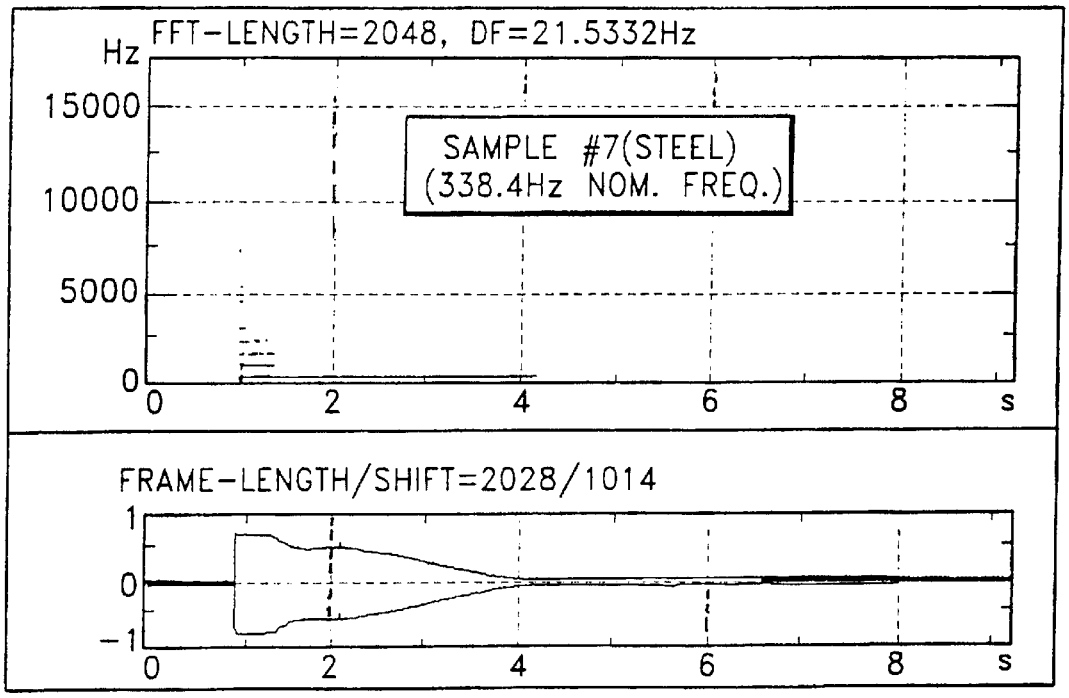

FIG. 16 illustrates the temperature response of sample #6A (NiTi/Steel hybrid) compared to that of sample #6 (Steel). The hybrid wire was formed by joining a small length of NiTi wire to a longer length of steel wire. The steel wire comprised the entire musically active length of the string, whereas the NiTi portion of the string was musically inactive and disposed between the hitch pin and bridge. In this particular experiment, the NiTi wire was not stretched to its superelastic state and so the hybrid string was still observed to be somewhat susceptible to expansion/contraction of the sound board as was the steel wire. The data indicates that the hybrid wire had an almost neutral temperature response corresponding to an effective coefficient of thermal expansion of about 0.09/° C. It is believed that this particular combination of steel and NiTi alloy wire and the tension were such that the natural thermal expansion of the NiTi and steel wire were approximately cancelled out or balanced by the contraction force of the NiTi wire due to the reduction of stress-induced martensitic transformation. The average variance (AVG VAR) of the hybrid wire was 13.7 compared to an average variance of 33.8 for the steel wire sample, indicating that the hybrid wire sample held more constant pitch with temperature change. The LSF variance (LSF VAR) for the hybrid sample was 10.4 versus 25.0 for the steel wire, indicating that the temperature response was more linear and predictable for the hybrid sample versus the steel sample.

FIGS. 17–24 are graphs illustrating measured frequency spectral responses for NiTi wire samples #1–6A and prior art steel wire samples #6 and #7. In each case, the nominal fundamental frequency is indicated. FIGS. 25–32 are graphs of measured vibratory decay responses for NiTi wire samples #1–6A and prior art steel wire samples #6 and #7. Again, in each case, the nominal fundamental frequency is indicated.

Figure 33:
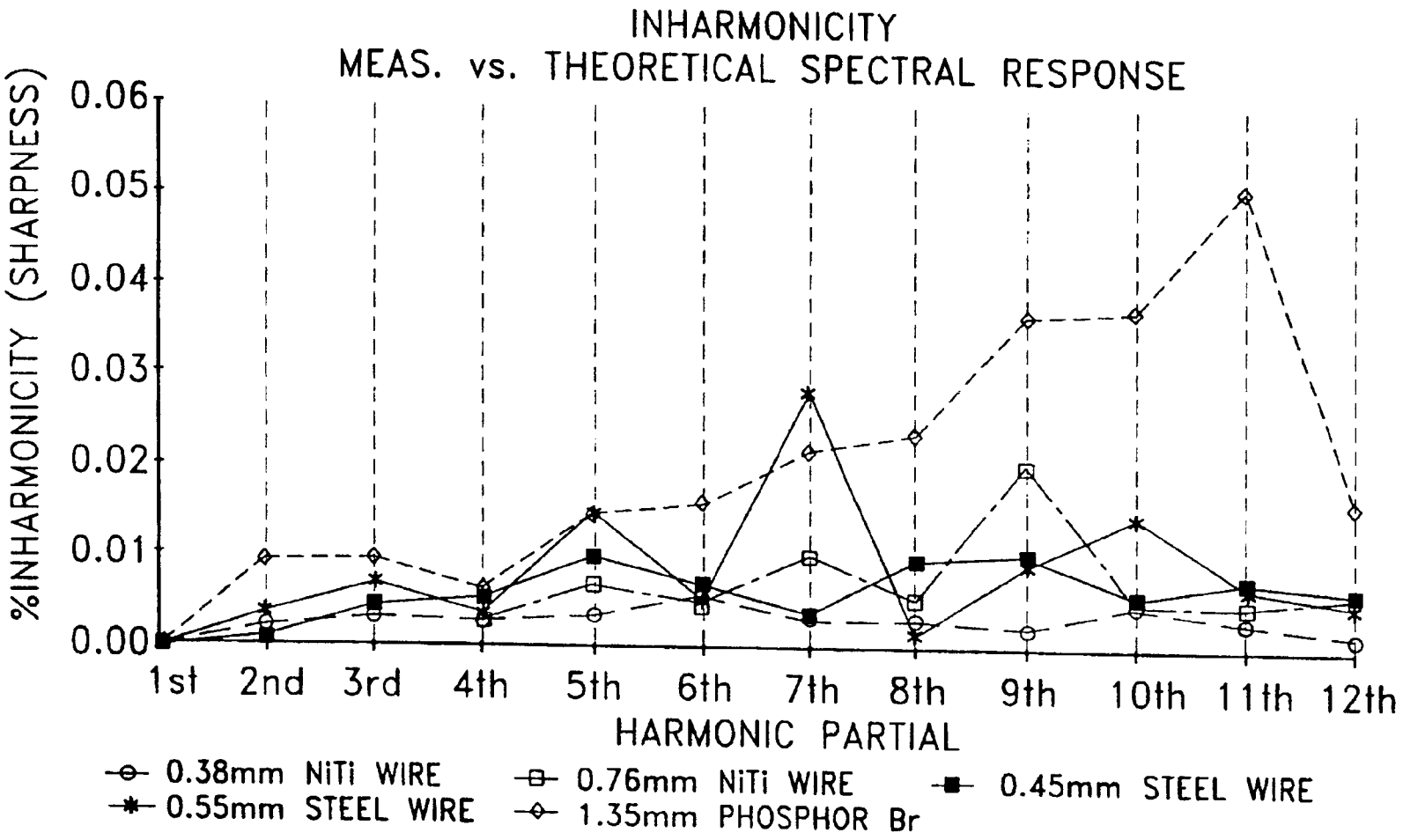
FIG. 33 is a comparative graph illustrating measured Inharmonicity of selected samples of NiTi wire compared to selected samples of prior art steel wire.

FIG. 33 is a comparative graph illustrating measured Inharmonicity of selected samples of NiTi wire compared to selected samples of prior art steel wire. The data generally indicates that the 0.38 mm NiTi wire sample was the best at reducing Inharmonicity of higher harmonic partials when compared to steel and bronze wires.

For convenience of description and illustration the improvements disclosed herein have sometimes been described and illustrated in the context of an acoustic piano. However, those skilled in the art will readily recognize that these same improvements may also be employed in a number of other musical instruments having vibratory strings, such as, without limitation, guitars, violins, base, harps, harpsichords and the like. Thus, although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

APPENDIX A

| Temp. (F.) | Temp. (C.) | Sample #1 | Sample #2 | Sample #3 | Sample #4 | Sample #5 | Sample #6 | Sample #6 | Sample #7 |
|---|---|---|---|---|---|---|---|---|---|
| 75.7 | 24.2 | 300.36 | 250.23 | 200.95 | 200.06 | 199.94 | No Data | 300.21 | 249.75 |
| 69.4 | 20.7 | 293.47 | 231.53 | 194.71 | 188.22 | 197.51 | No Data | 299.31 | 251.64 |
| 77.4 | 25.2 | 299.29 | 252.77 | 201.52 | 199.64 | 199.76 | No Data | 293.57 | 247.2 |
| 75 | 23.8 | 299.06 | 246.78 | 199.03 | 196.26 | 198.78 | No Data | 295.14 | 247.51 |
| 73.8 | 23.2 | 298.45 | 244.51 | 198.75 | 194.28 | 197.36 | No Data | 296.21 | 248.81 |
| 71.4 | 21.8 | 296.27 | 238.64 | 197.24 | 191.43 | 197.07 | No Data | 299.29 | 251.28 |
| 72.7 | 22.6 | 296.47 | 240.03 | 197.52 | 193.01 | 197.47 | No Data | 299.43 | 251.41 |
| 69.4 | 20.7 | 293.15 | 233.12 | 194.13 | 188.63 | 195.57 | No Data | 298.51 | 250.2 |
| 71.1 | 21.7 | 296.51 | 237.24 | 198.61 | 193.46 | 198.56 | No Data | 304.41 | 255.82 |
| 72.7 | 22.6 | 298.41 | 241.18 | 198.87 | 191.45 | 193.09 | 299.65 | 299.51 | 250.86 |
| 74.5 | 23.6 | 298.62 | 242.33 | 198.37 | 191.44 | 191.73 | 298.16 | 296.33 | 248.225 |
| 70.7 | 21.5 | 295.54 | 236.31 | 195.75 | 188.76 | 190.95 | 296.41 | 296.37 | 248.06 |
| 77.2 | 25.1 | 297.47 | 250.93 | 197.46 | 192.7 | 190.07 | 295.79 | 285.56 | 237.92 |
| 75.2 | 24 | 296.7 | 245.41 | 195.62 | 190.62 | 188.72 | 294.05 | 285.74 | 237.65 |
| 74.3 | 23.5 | 296.41 | 245.31 | 195.44 | 189.12 | 188.46 | 295.25 | 286.77 | 239.08 |
| 68.2 | 20.1 | 289.47 | 226.3 | 189.31 | 180.06 | 186.15 | 290.51 | 291.07 | 241.85 |
| 73.2 | 22.8 | 298.26 | 245.23 | 197.93 | 191.32 | 191.17 | 296.57 | 295.85 | 246.11 |
| 77 | 25 | 298.56 | 252.43 | 197.41 | 192.87 | 190.07 | 295.18 | 287.43 | 238.99 |
| 73.8 | 23.2 | 295.76 | 242.65 | 195.12 | 188.57 | 188.48 | 293.65 | 290.24 | 240.88 |
| 70.2 | 21.2 | 295.11 | 234.02 | 193.74 | 185.15 | 188.51 | 293.47 | 295.56 | 245.11 |
| 77.5 | 25.2 | 299.69 | 253.22 | 199.44 | 194.41 | 191.14 | 295.72 | 291.23 | 242.23 |
| 76.6 | 24.7 | 298.8 | 250.37 | 198.54 | 193.26 | 190.53 | 296.51 | 291.14 | 242.06 |
| 72.9 | 22.7 | 296.41 | 242.12 | 196.83 | 189.86 | 189.63 | 296.31 | 296.45 | 247.03 |
| 78.3 | 25.7 | 299.19 | 253.14 | 197.44 | 192.75 | 188.97 | 295.27 | 288.61 | 239.31 |
| 72.8 | 22.6 | 296.47 | 240.76 | 196.26 | 188.62 | 188.67 | 295.42 | 296.15 | 245.68 |
| 73.6 | 23.1 | 300.62 | 245.03 | 200.18 | 192.73 | 192.21 | 300.92 | 301.63 | 251.04 |
| 70.1 | 21.1 | 296.18 | 234.32 | 196.6 | 186.81 | 190.91 | 298.81 | 303.77 | 252.92 |
| 72.8 | 22.6 | 298.69 | 241.69 | 199.05 | 190.46 | 190.77 | 298.47 | 301.02 | 250.53 |
| 73 | 22.7 | 299.36 | 243.2 | 199.31 | 191.15 | 191.22 | 298.81 | 299.62 | 250.27 |
| 70.9 | 21.6 | 298.09 | 237.53 | 198.11 | 188.17 | 191.15 | 299.22 | 302.41 | 252.56 |
| 74.7 | 23.7 | 302.23 | 248.23 | 202.07 | 195.65 | 193.43 | 301.39 | 301.79 | 252.58 |
| 75.9 | 24.3 | 301.27 | 249.68 | 199.82 | 193.24 | 191.22 | 296.97 | 297.39 | 247.91 |
| 70.9 | 21.6 | 295.79 | 233.85 | 195.71 | 185.19 | 189.31 | 294.04 | 300.25 | 250.64 |
| 77.7 | 25.3 | 298.65 | 250.62 | 196.57 | 190.14 | 186.61 | 292.21 | 285.01 | 236.79 |
| 70.9 | 21.6 | 292.52 | 233.65 | 191.25 | 181.41 | 184.86 | 287.13 | 287.91 | 239.22 |
| 71.8 | 22.1 | 292.04 | 236.63 | 190.39 | 182.36 | 182.25 | 284.93 | 285.12 | 236.23 |
| 77.5 | 25.2 | 298.61 | 250.77 | 196.12 | 188.95 | 186.17 | 290.81 | 287.53 | 238.22 |
| 77.2 | 25.1 | 299.31 | 252.84 | 198.28 | 191.24 | 188.71 | 292.82 | 288.15 | 239.31 |

What is claimed is:

1. A vibratory string for musical instruments comprising an alloy wire material selected to have superelastic properties at or about room temperature.

2. A musical instrument strung with a vibratory string as recited in claim 1, said string being tensioned or strained to its superelastic state.

3. A method of stringing a musical instrument using the vibratory string of claim 1, said method comprising the following steps:

securing a first end of said string to said instrument;

securing a second end of said string to said instrument;

supporting said string on said instrument so as to provide an active length thereof capable of sustained vibration; and tensioning or straining said string to its superelastic state.

4. The vibratory string of claim 1 wherein said alloy comprises a Ni—Ti alloy comprising between about 49.0 to 50.7% Ti.

5. The vibratory string of claim 4 wherein said alloy comprises a Ni—Ti alloy comprising between about 49.0 to 49.4% Ti.

6. The vibratory string of claim 1 wherein said alloy comprises a Ni—Ti alloy having a transformation temperature between about 15° C. and −200° C.

7. The vibratory string of claim 1 wherein said 1 wire alloy material is further coated or wound with a precious or semiprecious metal or alloy comprising copper, gold or silver.

8. A musical instrument strung with one or more vibratory strings as recited in claim 1.

9. The musical instrument of claim 8 wherein at least one of said vibratory strings is tensioned or strained to its superelastic condition.

10. The musical instrument of claim 9 wherein at least one of said vibratory strings comprises a Ni—Ti alloy having a characteristic thermoelastic martensitic phase transformation at a transformation temperature (TT) and wherein said string is tensioned or strained to the point of causing stress-induced crystalline transformation from an austenitic crystalline structure to a martensitic crystalline structure.

11. The musical instrument of claim 10 wherein said Ni—Ti alloy is selected to have a transformation temperature (TT) between about 15° C. and —200° C.

12. The musical instrument of claim 11 wherein said Ni—Ti alloy comprises between about 49.0 to 49.4% Ti.

13. A method of tuning the musical instrument of claim 8, comprising the step of tensioning or straining each said vibratory string to its superelastic state and then continuing to strain each said vibratory string until a desired pitch is achieved.

14. The musical instrument of claim 8 wherein one or more of said vibratory strings is impregnated, coated or wound with a precious or semiprecious metal or alloy thereof.

15. An acoustic piano comprising the musically tuned vibratory string of claim 1.

16. A method of stringing a stringed musical instrument, said method comprising the following steps:

selecting a vibratory string comprising one or more wires formed of an alloy material having superelastic properties at or about room temperature;

securing a first end of said string to said instrument;

securing a second end of said string to said instrument;

supporting said string on said instrument so as to provide an active length thereof capable of sustained vibration; and tensioning or straining said string to its superelastic state.

17. A musical instrument strung using the method of claim 16 and wherein at least one of said vibratory strings comprises a Ni—Ti alloy having a characteristic thermoelastic martensitic phase transformation at a transformation temperature (TT) below room temperature and wherein said string is tensioned or strained to the point of causing at least some stress-induced crystalline transformation from an austenitic crystalline structure to a martensitic crystalline structure.

18. The method of claim 16 wherein said vibratory string is selected to comprise one or more wires formed of a Ni—Ti alloy having a characteristic thermoelastic martensitic phase transformation at a transformation temperature (TT) below room temperature and wherein said string is tensioned or strained to the point of causing at least some stress-induced crystalline transformation from an austenitic crystalline structure to a martensitic crystalline structure.

19. The method of claim 18 wherein said Ni—Ti alloy comprises between about 49.0 to 49.4% Ti.

20. The method of claim 18 wherein said Ni—Ti alloy is selected to have a transformation temperature (TT) between about −100° C. and −200° C.

21. The method of claim 16 comprising the further step of impregnating, coating or winding said vibratory string with a precious or semiprecious metal or alloy thereof.

22. A vibratory string for a musical instrument having an effective thermal expansion coefficient of or about 0.0° C.

23. The vibratory string of claim 22 wherein said string comprises a titanium alloy comprising between about 49.0 to 50.7% titanium (Ti) and the balance, including trace elements, comprising one or more of the following: oxygen (O), nitrogen (N), iron (Fe), aluminum (Al), chromium (Cr), cobalt (Co) vanadium (V), zirconium (Zr), copper (Cu), or nickel (Ni).

24. The vibratory string of claim 23 wherein said string comprises a Ni—Ti alloy having a characteristic thermoelastic martensitic phase transformation at a transformation temperature (TT) and wherein said string is tensioned or strained to the point of causing at least some stress-induced crystalline transformation from an austenitic crystalline structure to a martensitic crystalline structure.

25. The vibratory string of claim 24 wherein said transformation temperature is between about 15° C. and −200° C.

26. A music string having improved harmonics, said string comprising an alloy material having a density lower than or equal to 6.45 g/cm$^3$ and having a modulus of elasticity (ME) and an ultimate tensile strength (UTS) selected such that the ratio of ME/UTS is less than about 100:1.

27. The music string of claim 26 wherein the ratio of ME/UTS is less than about 50:1.

28. The music string of claim 26 wherein the ratio of ME/UTS is less than about 40:1.

29. The music string of claim 26 wherein said alloy material comprises a titanium alloy.

30. The music string of claim 26 wherein said alloy material comprises at least 49% by weight titanium (Ti) and the balance, including trace elements, comprising one or more of the following: oxygen (O), nitrogen (N), iron (Fe), aluminum (Al), chromium (Cr), cobalt (Co) vanadium (V), zirconium (Zr), copper (Cu), or nickel (Ni).

31. The music string of claim 26 wherein said alloy material is selected to have a modulus of elasticity less than about 90 GPa.

32. The music string of claim 26 wherein said alloy is selected to have an ultimate tensile strength between 895 MPa and 1900 MPa.

33. A guitar string having improved harmonics and corrosion resistance, said string comprising an alloy material comprising at least 49% by weight titanium and the balance, including trace elements, comprising one or more of the following: oxygen (O), nitrogen (N), iron (Fe), aluminum (Al), chromium (Cr), cobalt (Co) vanadium (V), zirconium (Zr), copper (Cu), or nickel (Ni), said alloy material being annealed, heat-treated and/or otherwise processed to produce a wire having an ultimate tensile strength (UTS) between 895 MPa and 1900 MPa.

34. The guitar string of claim 33 wherein said alloy material is selected to have a density lower than or equal to 6.45 g/cm$^3$.

35. The guitar string of claim 33 wherein the modulus of elasticity (ME) of said alloy material is selected such that the ratio of ME/UTS is less than about 100:1.

36. The guitar string of claim 33 wherein the modulus of elasticity (ME) of said alloy material is selected such that the ratio of ME/UTS is less than about 50:1.

37. The guitar string of claim 33 wherein the modulus of elasticity (ME) of said alloy material is selected such that the ratio of ME/UTS is less than about 40:1.

38. The guitar string of claim 33 wherein said alloy material is selected to have a modulus of elasticity (ME) less than about 90 GPa.

39. The guitar string of claim 33 wherein said alloy material is selected to have a modulus of elasticity (ME) less than about 75 GPa.

40. The guitar string of claim 33 wherein said alloy material is annealed, heat-treated and/or otherwise processed to produce a wire material having a substantially austenite crystalline structure at room temperature.

41. The guitar string of claim 33 wherein said alloy material comprises a superelastic Ni—Ti alloy having a characteristic thermoelastic martensitic phase transformation at a transformation temperature (TT) and wherein said string is tensioned or strained to the point of causing at least some stress-induced crystalline transformation from an austenitic crystalline structure to a martensitic crystalline structure.

42. The guitar string of claim 41 wherein said transformation temperature is between about 15° C. and −200° C.

43. The guitar string of claim 33 wherein said wire is further coated or wound with a precious or semiprecious metal or alloy comprising copper, gold or silver.

* * * * *